US007922353B2

(12) United States Patent
Isely

(10) Patent No.: US 7,922,353 B2
(45) Date of Patent: Apr. 12, 2011

(54) APPARATUS, METHOD AND SYSTEM FOR PROVIDING MULTI-MODE ILLUMINATION

(76) Inventor: Larson Isely, Raleigh, NC (US)

( * ) Notice: Subject to any disclaimer, the term of this patent is extended or adjusted under 35 U.S.C. 154(b) by 0 days.

(21) Appl. No.: 11/688,849

(22) Filed: Mar. 20, 2007

(65) Prior Publication Data

US 2007/0297184 A1 Dec. 27, 2007

Related U.S. Application Data

(60) Provisional application No. 60/784,119, filed on Mar. 20, 2006.

(51) Int. Cl.
*F21V 9/16* (2006.01)
*F21S 6/00* (2006.01)
*F21S 10/00* (2006.01)

(52) U.S. Cl. ..... 362/231; 362/228; 362/249.01; 362/249.12; 362/249.14

(58) Field of Classification Search ..... 362/382, 362/413, 414, 418, 419, 420, 431, 184, 228, 362/230, 231, 233, 240, 249.01–249.19, 362/293, 294; 250/495.1, 504 R; 340/815.45, 340/815.4

See application file for complete search history.

(56) References Cited

U.S. PATENT DOCUMENTS

| | | | | |
|---|---|---|---|---|
| 3,223,826 | A * | 12/1965 | Macaluso, Jr. | 392/413 |
| 3,233,092 | A | 2/1966 | Umholtz | |
| 3,593,013 | A * | 7/1971 | Mertes | 362/386 |
| 3,703,635 | A * | 11/1972 | Burkarth | 362/300 |
| 3,963,972 | A | 6/1976 | Todd | |
| 4,244,011 | A | 1/1981 | Hammel et al. | |
| 4,575,784 | A | 3/1986 | Diau | |
| 5,122,781 | A * | 6/1992 | Saubolle | 340/473 |
| 5,344,339 | A | 9/1994 | Cheslock | |
| 5,630,660 | A * | 5/1997 | Chen | 362/183 |
| 5,677,669 | A * | 10/1997 | Walkley et al. | 340/473 |
| 5,695,272 | A * | 12/1997 | Snyder et al. | 362/231 |
| 5,955,866 | A | 9/1999 | Peng | |
| 5,982,138 | A | 11/1999 | Krieger | |
| 5,993,022 | A | 11/1999 | Neyer et al. | |
| 6,215,273 | B1 | 4/2001 | Shy | |
| D444,125 | S | 6/2001 | Shy | |
| 6,265,969 | B1 * | 7/2001 | Shih | 340/468 |
| 6,567,248 | B1 * | 5/2003 | Schmidt et al. | 362/470 |

(Continued)

FOREIGN PATENT DOCUMENTS

GB 2270333 A * 3/1994

*Primary Examiner* — Alan Cariaso
(74) *Attorney, Agent, or Firm* — Alston & Bird LLP

(57) ABSTRACT

In light of the foregoing background, exemplary embodiments of the present invention provide an improved apparatus, method and system for providing multi-mode illumination. Specifically, exemplary embodiments of the present invention include a lighting apparatus capable of multiple modes of illumination (e.g., infrared illumination mode, visible light illumination mode, spot-light mode, flood-light mode, blended spot and flood light modes, etc.) and battery powered operation. The lighting apparatus further includes a fuel gage module capable of communicating an expected battery life based on a current operating mode of the lighting apparatus and a current state of charge of the battery. Lighting devices structured in accordance with various embodiments of the present invention may be light-weight and portable to improve ease of transport and deployment. Such lighting devices may also include a stable and yet retractable mounting device. In this regard, such lighting devices may be transported to remote locations and for providing a reliable light source.

9 Claims, 36 Drawing Sheets

U.S. PATENT DOCUMENTS

| | | | | |
|---|---|---|---|---|
| 6,616,300 | B1 | 9/2003 | Hrabal | |
| D481,813 | S | 11/2003 | Krieger et al. | |
| 6,756,764 | B2 | 6/2004 | Smith et al. | |
| 7,023,004 | B2 * | 4/2006 | Ford et al. | 250/495.1 |
| 7,452,099 | B2 | 11/2008 | Evans et al. | |
| 2002/0075679 | A1 * | 6/2002 | Machi et al. | 362/231 |
| 2002/0136005 | A1 * | 9/2002 | Lee | 362/171 |
| 2004/0130891 | A1 | 7/2004 | Twardawski | |
| 2004/0141316 | A1 | 7/2004 | Twardawski | |
| 2005/0117340 | A1 * | 6/2005 | Lee et al. | 362/252 |

* cited by examiner

SYSTEM SCHEMATIC

APPARATUS, METHOD AND SYSTEM FOR PROVIDING MULTI-MODE ILLUMINATION

CROSS-REFERENCE TO RELATED APPLICATIONS

The present application claims priority to U.S. Provisional Application No. 60/784,119 entitled APPARATUS, METHOD AND SYSTEM FOR PROVIDING MULTI-MODE ILLUMINATION, which was filed Mar. 20, 2006; the contents of which are incorporated herein in their entirety.

FIELD OF THE INVENTION

Embodiments of the present invention generally relate to systems and methods for providing illumination and, more particularly, to an apparatus, method and system for providing multi-mode illumination.

BACKGROUND OF THE INVENTION

Military assets such as aircraft, for example, are often stationed at forward deployed bases. Many such forward deployed bases are austere and remotely located airfields with insufficient lighting and security systems. Accordingly, it is often desirable to transport lighting systems to the forward deployed bases. Conventional lighting systems may be very heavy and difficult to transport to remote locations. The generally require too much energy and are not equipped to provide a defined boundary between an illuminated "watch area" and a non-illuminated "secure area", where the presence of light would only highlight the object that is to be secured.

Conventional lighting systems often employ halogen, fluorescent, or incandescent lighting, which introduce numerous disadvantages into security applications. Incandescent lighting consumes relatively large amounts of energy and requires frequency replacement of lighting elements. Halogen lighting also consumes relatively large amounts of energy and has a high thermal load, which can be a disadvantage in environments where covertness is desired. Finally, fluorescent lighting produces relatively large amounts of electromagnetic interference and generally includes mercury, which is a pollutant that has high disposal costs.

It would be desirable then to produce a mobile, lightweight, lighting system that is adapted to illuminate a selected area while consuming a relatively reduced amount of energy as compared to halogen, fluorescent, or incandescent light sources. It would be further desirable to produce a lighting system that is adapted to define a formal boundary between an illuminated and a non-illuminated area.

SUMMARY OF THE INVENTION

In light of the foregoing background, exemplary embodiments of the present invention provide an improved apparatus, method and system for providing multi-mode illumination. Specifically, exemplary embodiments of the present invention include a lighting apparatus capable of multiple modes of illumination (e.g., infrared illumination mode, visible light illumination mode, spot-light mode, flood-light mode, blended spot and flood light modes, etc.) and battery powered operation. The lighting apparatus further includes a fuel gage module capable of communicating an expected battery lift based on a current operating mode of the lighting apparatus and a current state of charge of the battery. Lighting devices structured in accordance with various embodiments of the present invention may be light-weight and portable to improve ease of transport and deployment. Such lighting devices may also include a stable and yet retractable mounting device. In this regard, such lighting devices may be transported to remote locations and for providing a reliable light source.

BRIEF DESCRIPTION OF THE DRAWINGS

Figure 1:
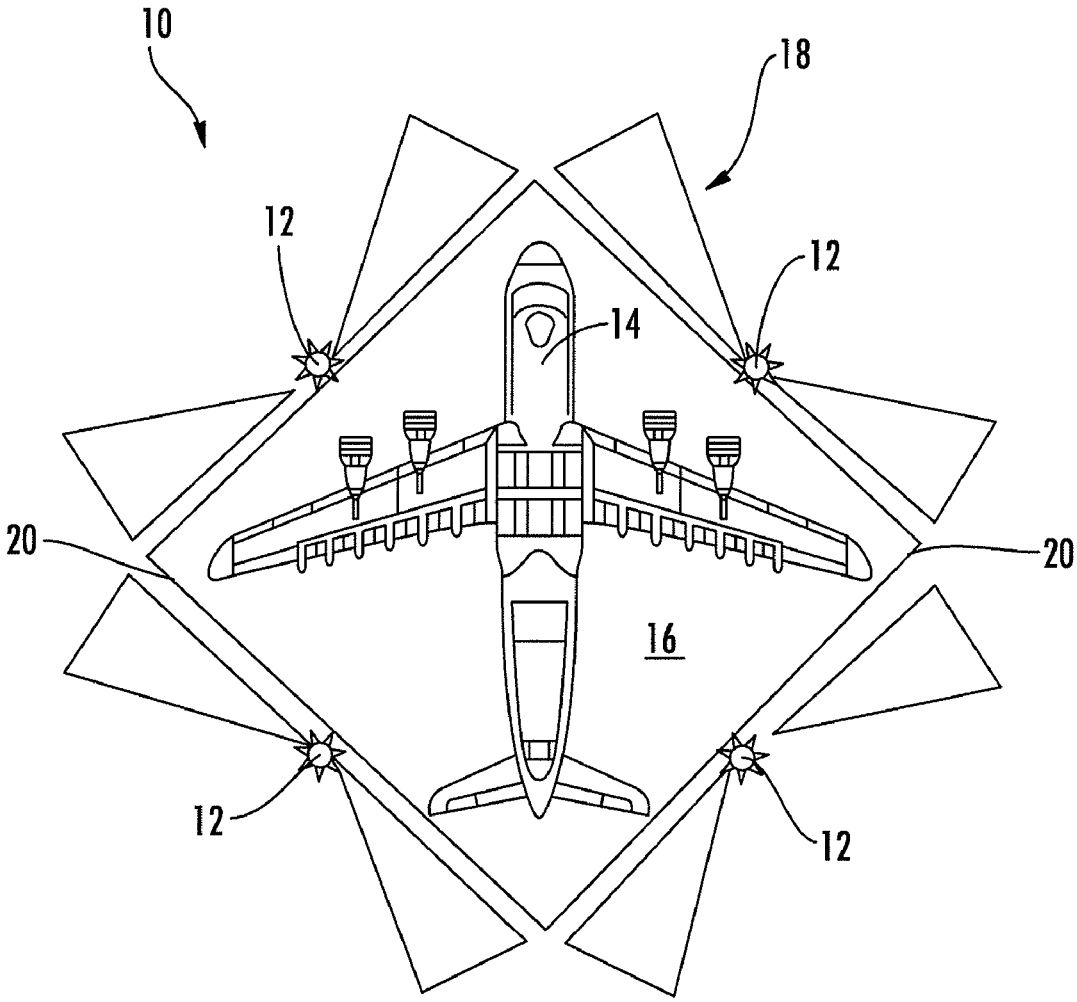
Figure 2:
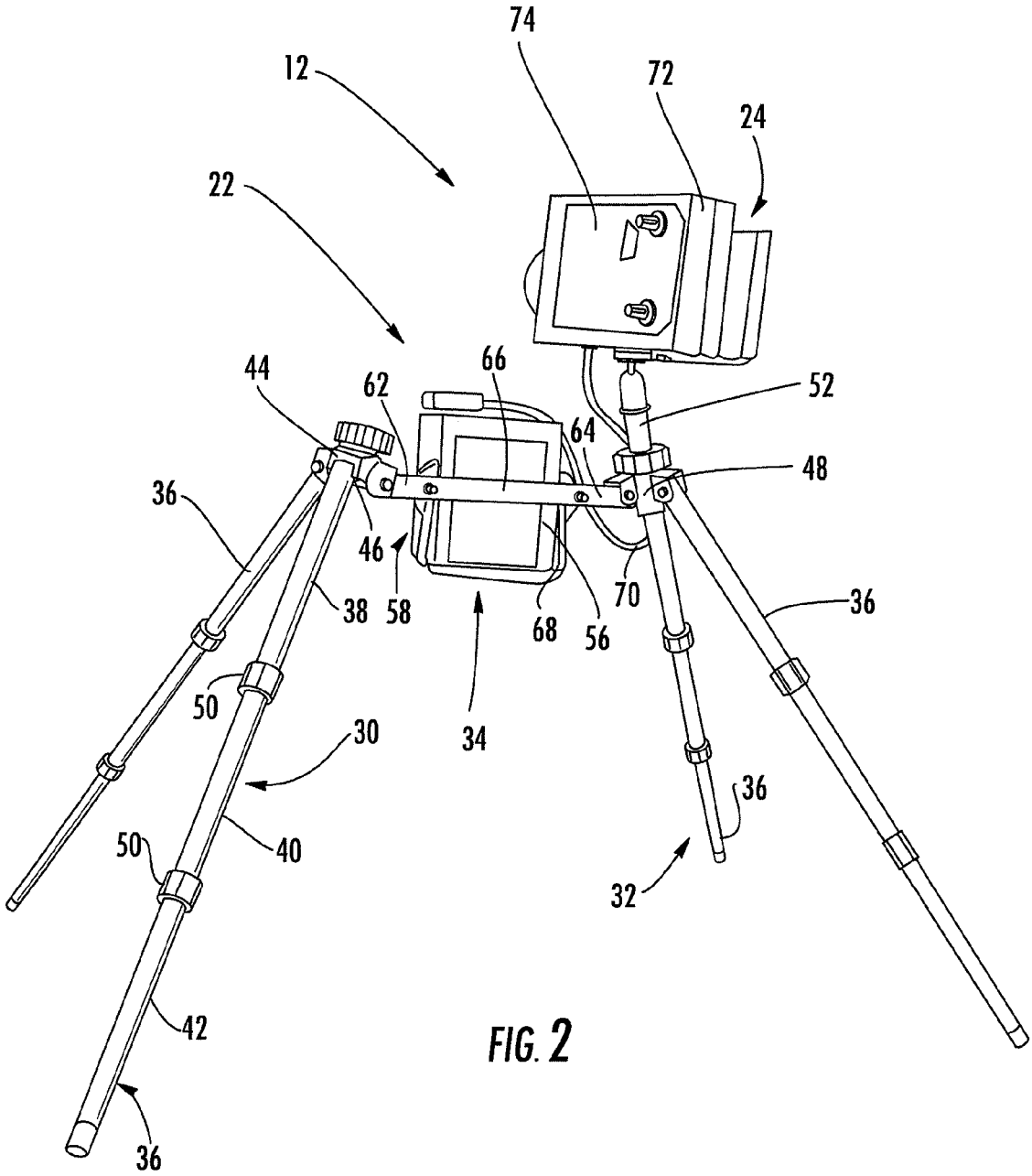
Figure 3:
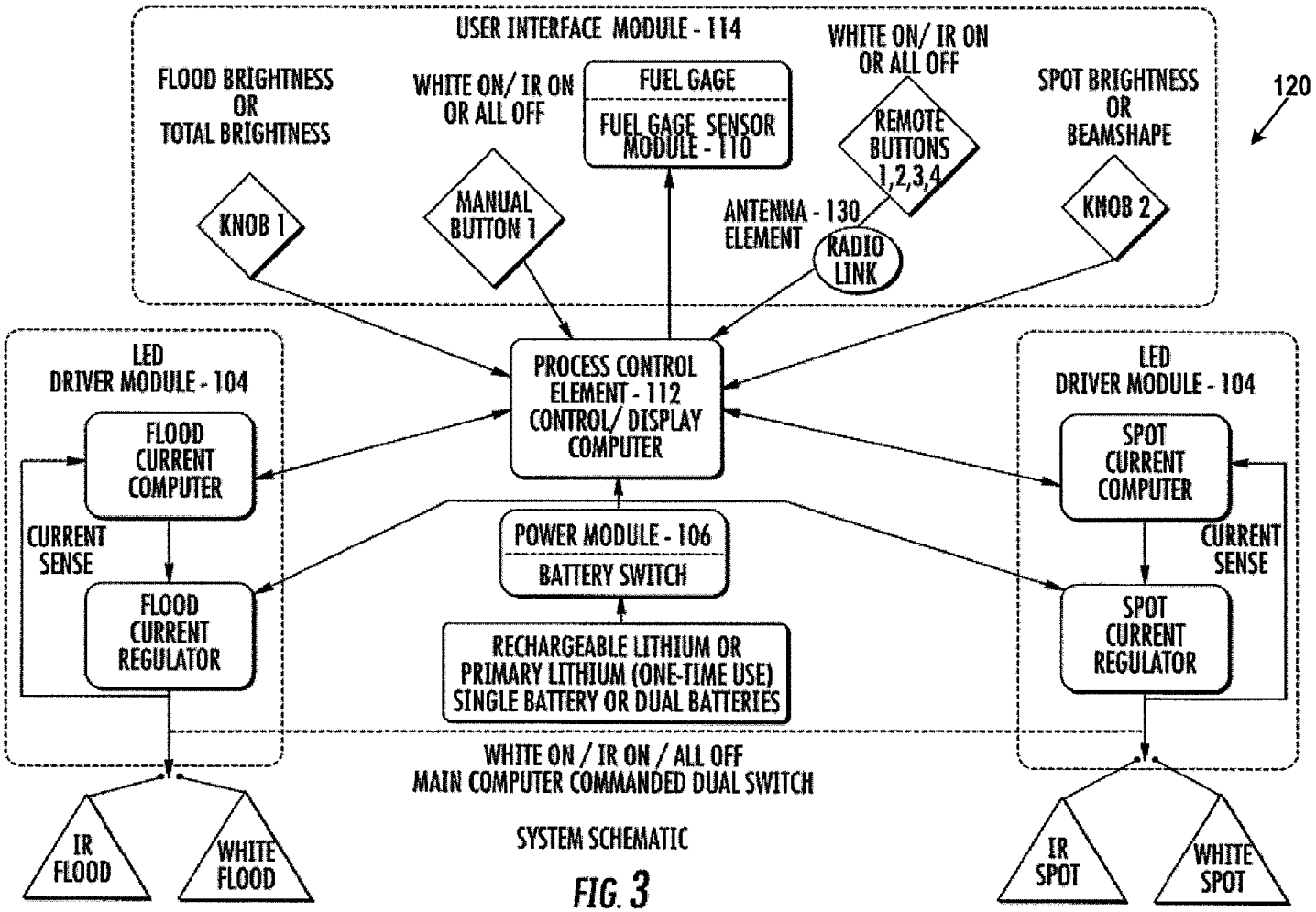
Figure 4:
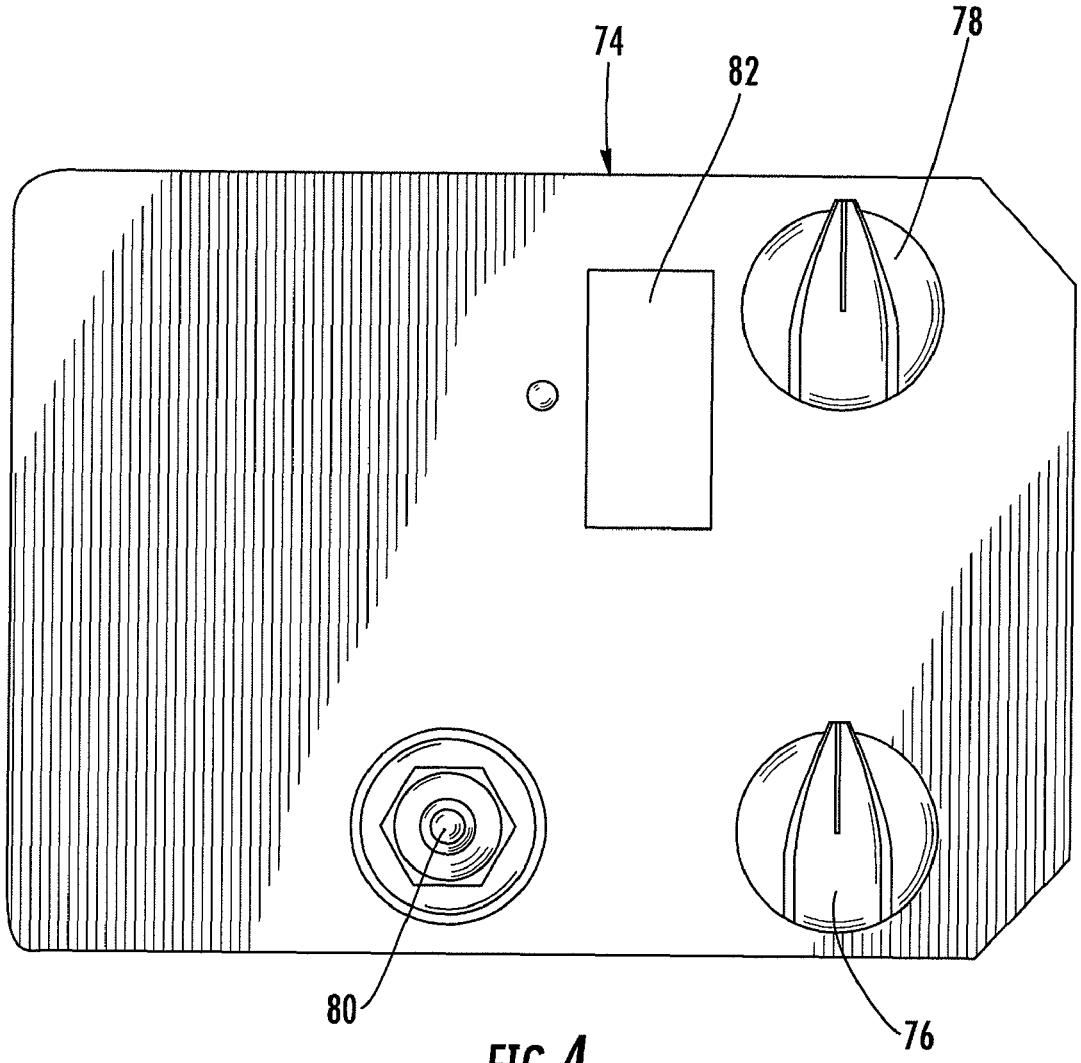
Figure 5:
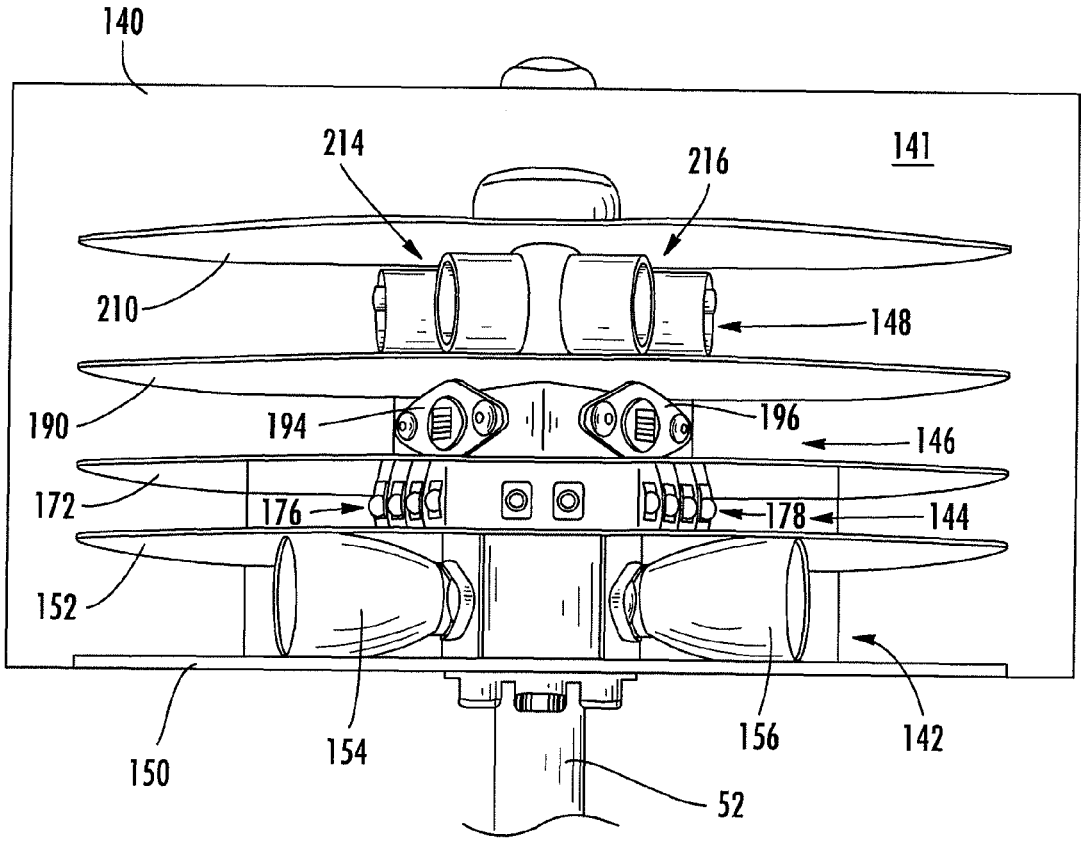
Figure 5A:
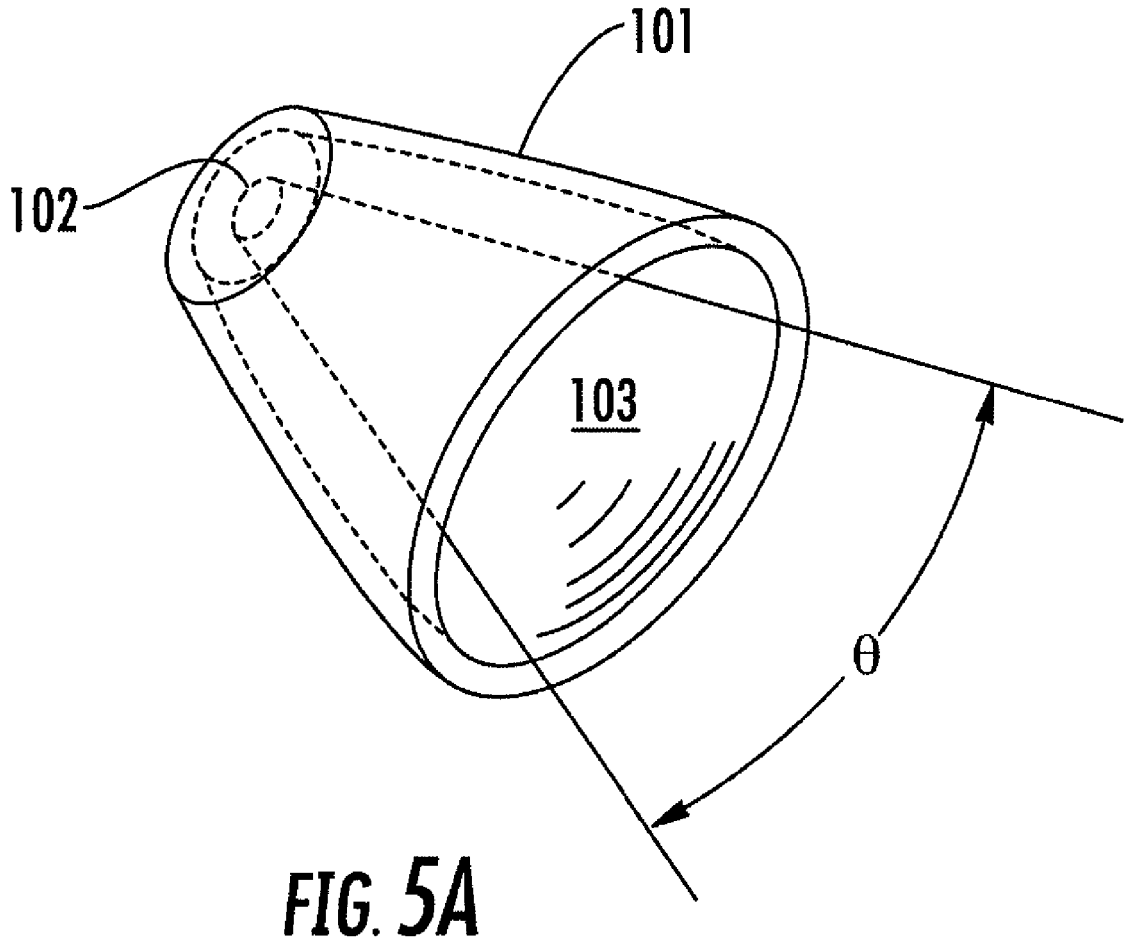
Figure 6:
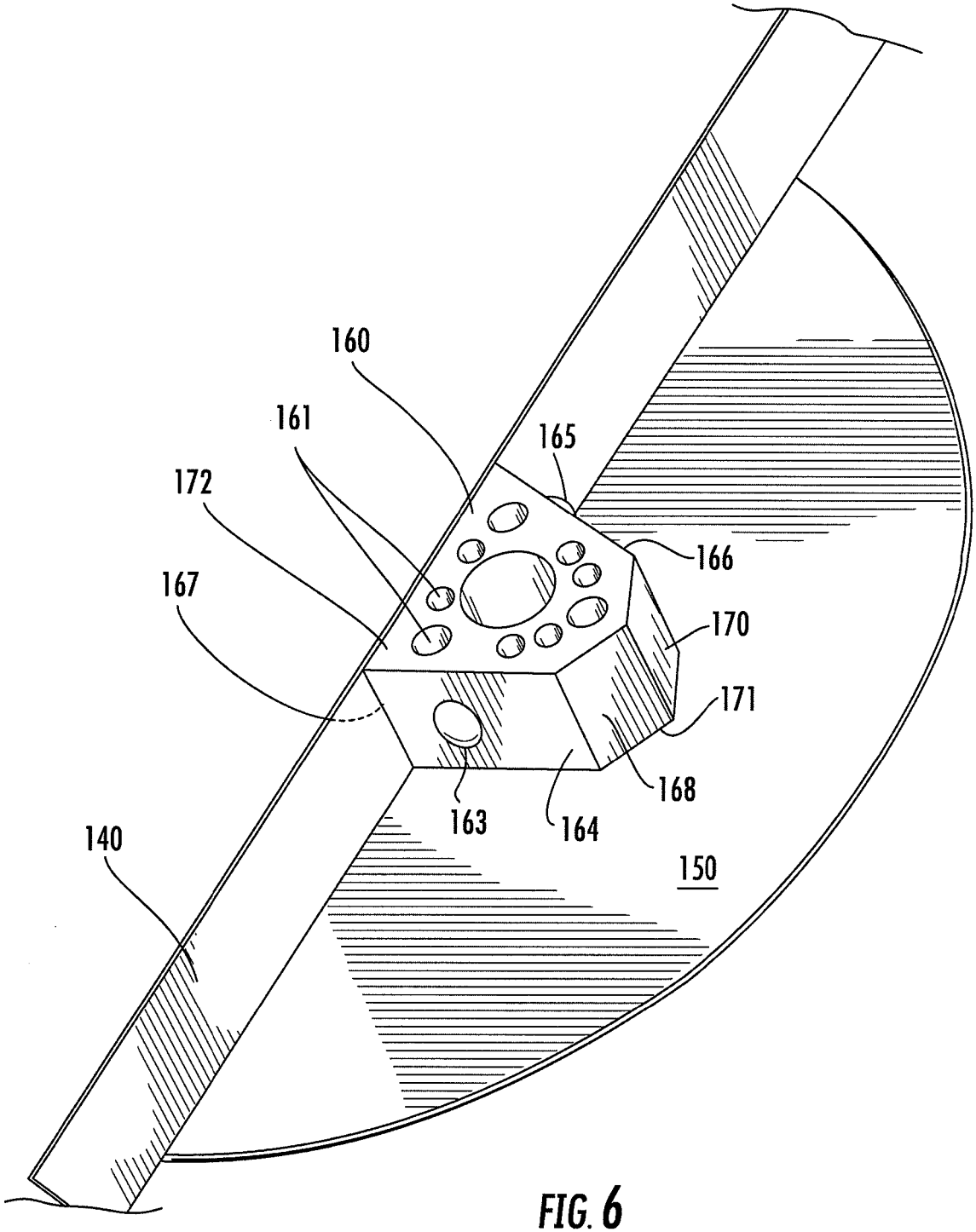
Figure 6A:
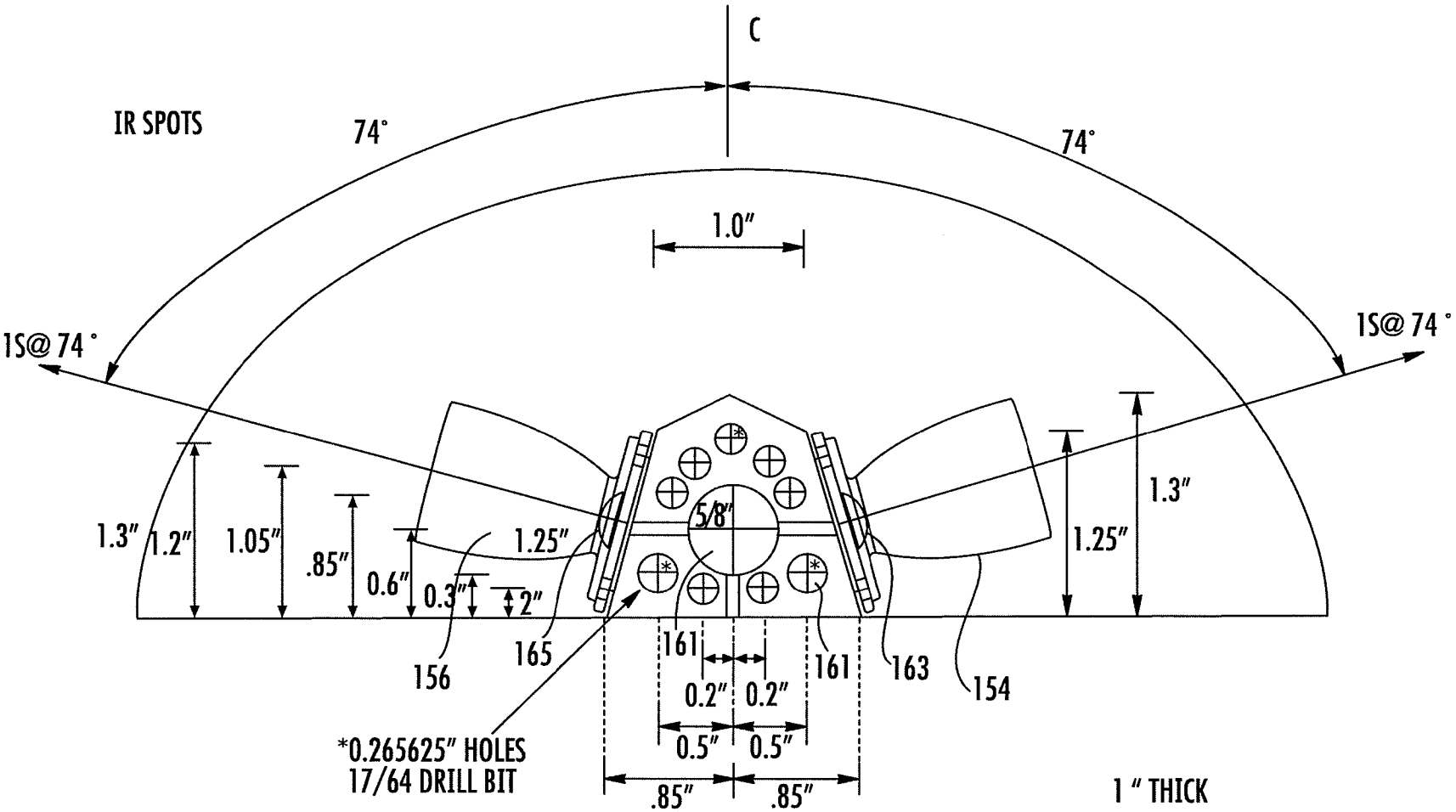
Figure 6B:
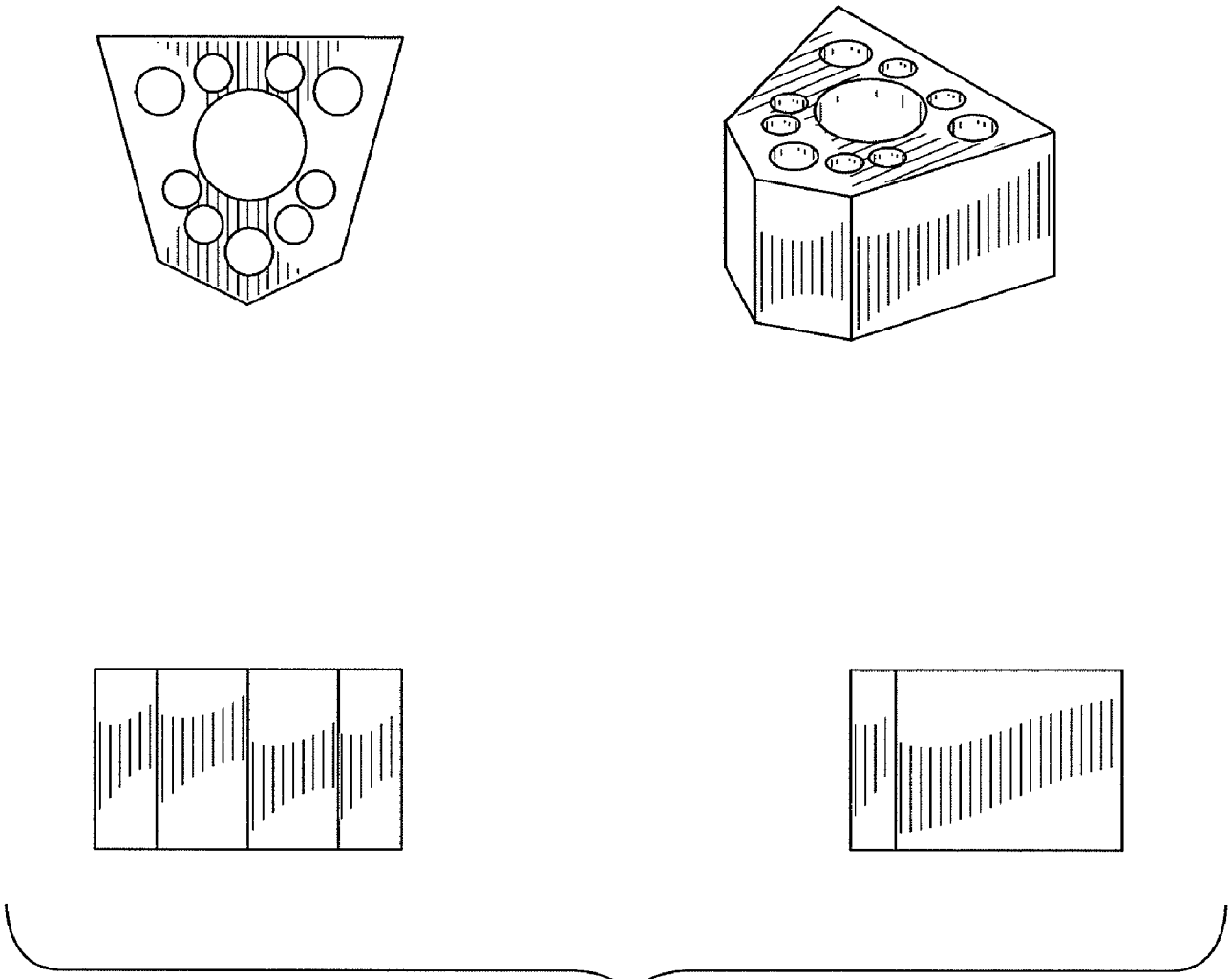
Figure 7:
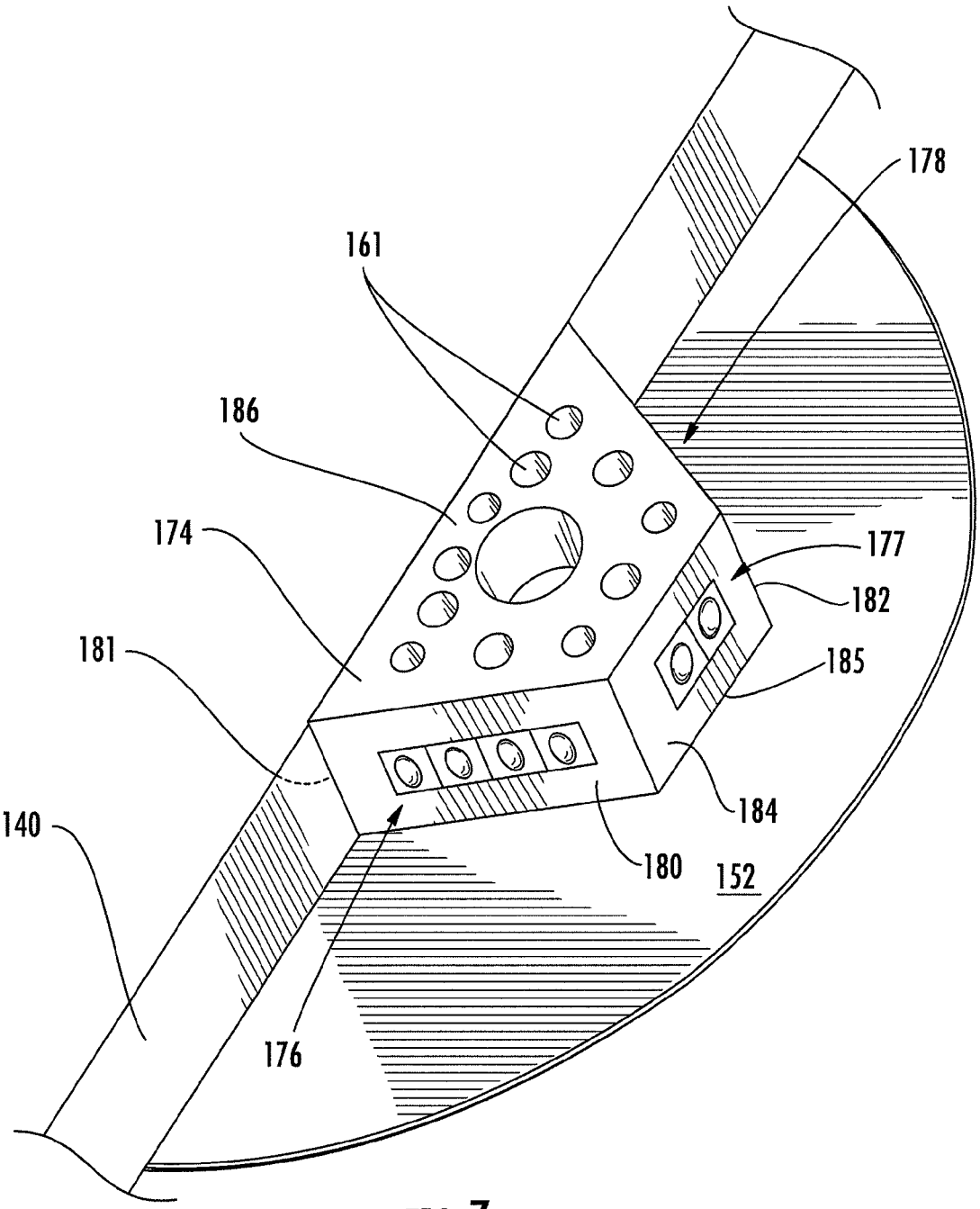
Figure 7A:
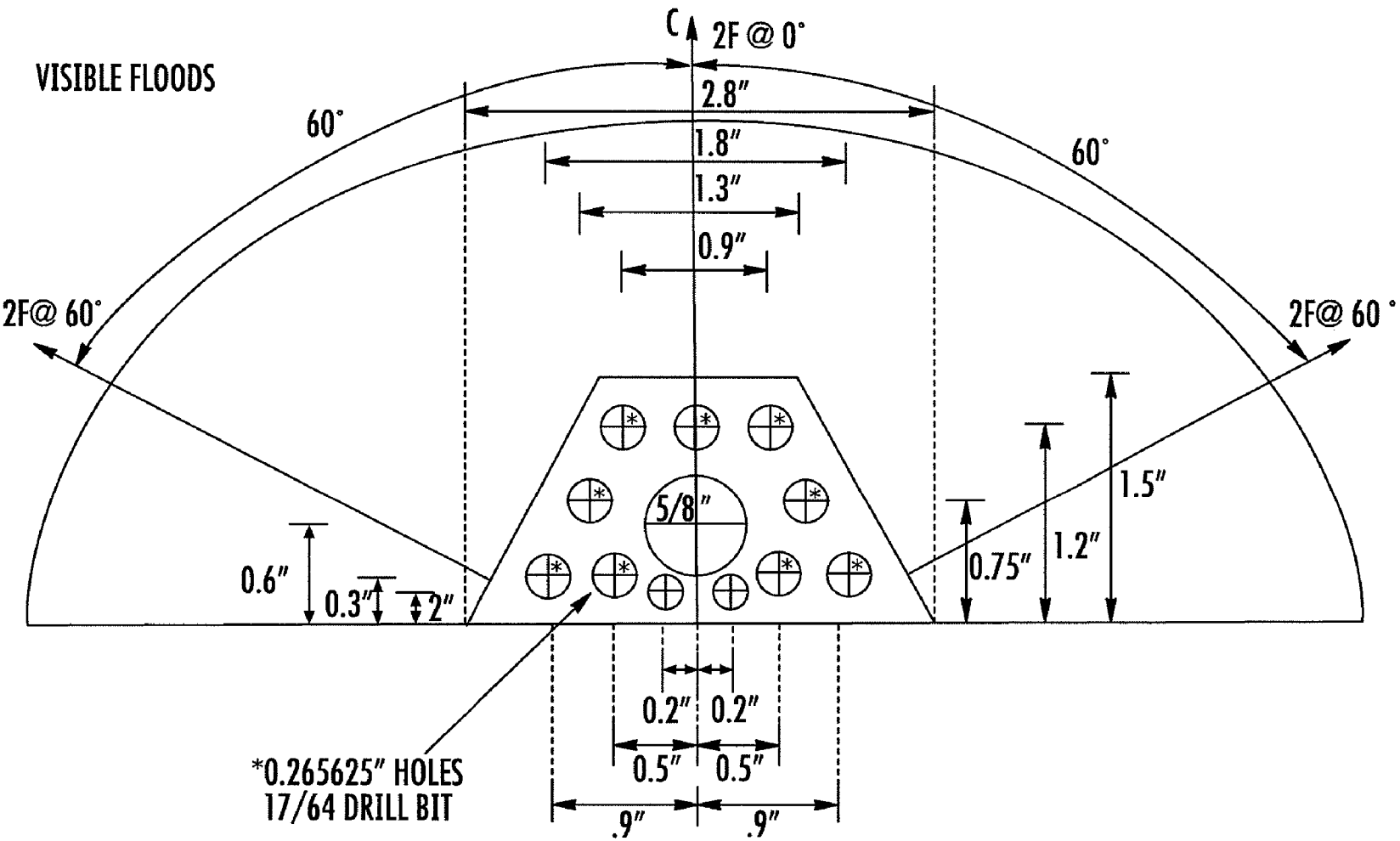
Figure 7B:
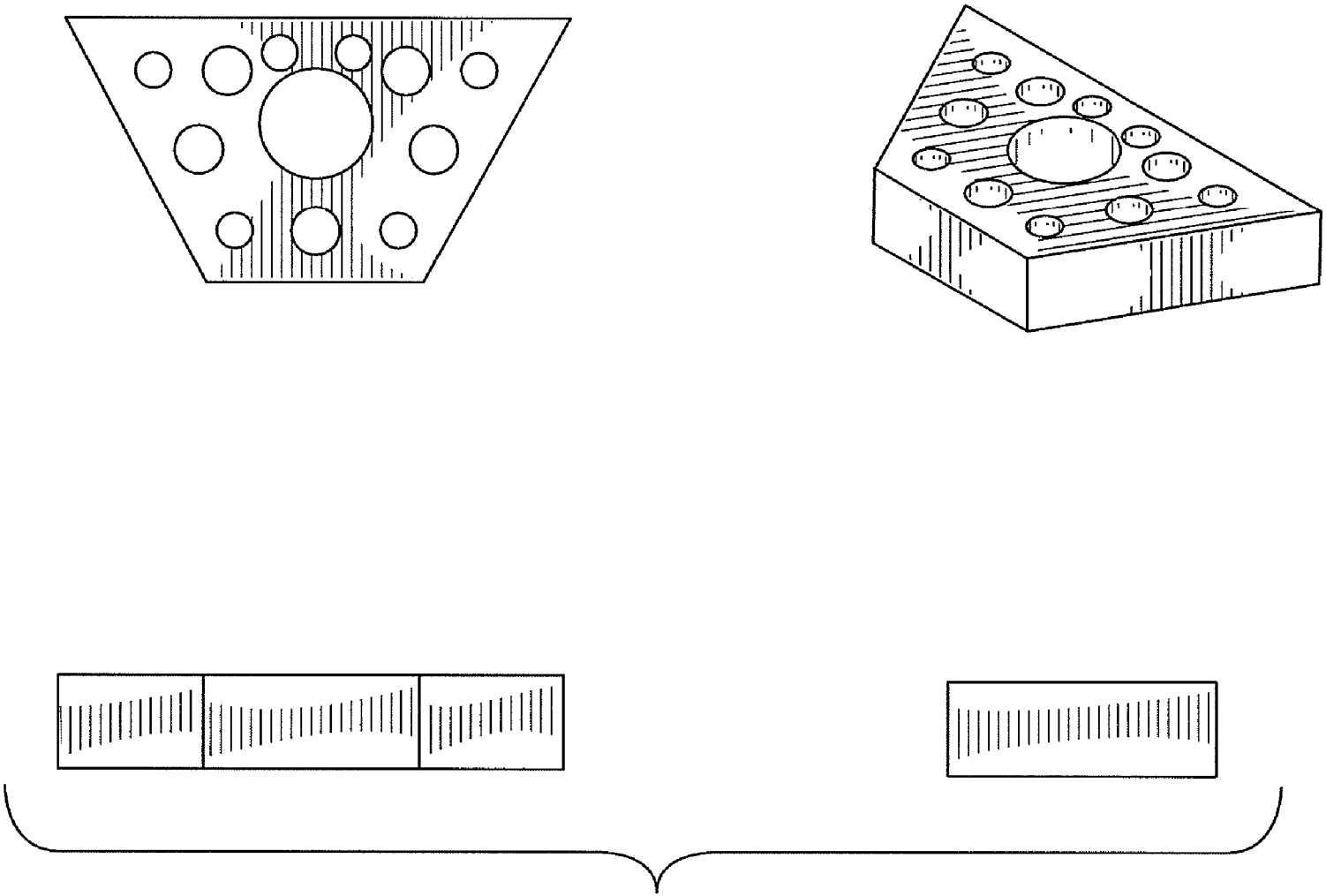
Figure 8:
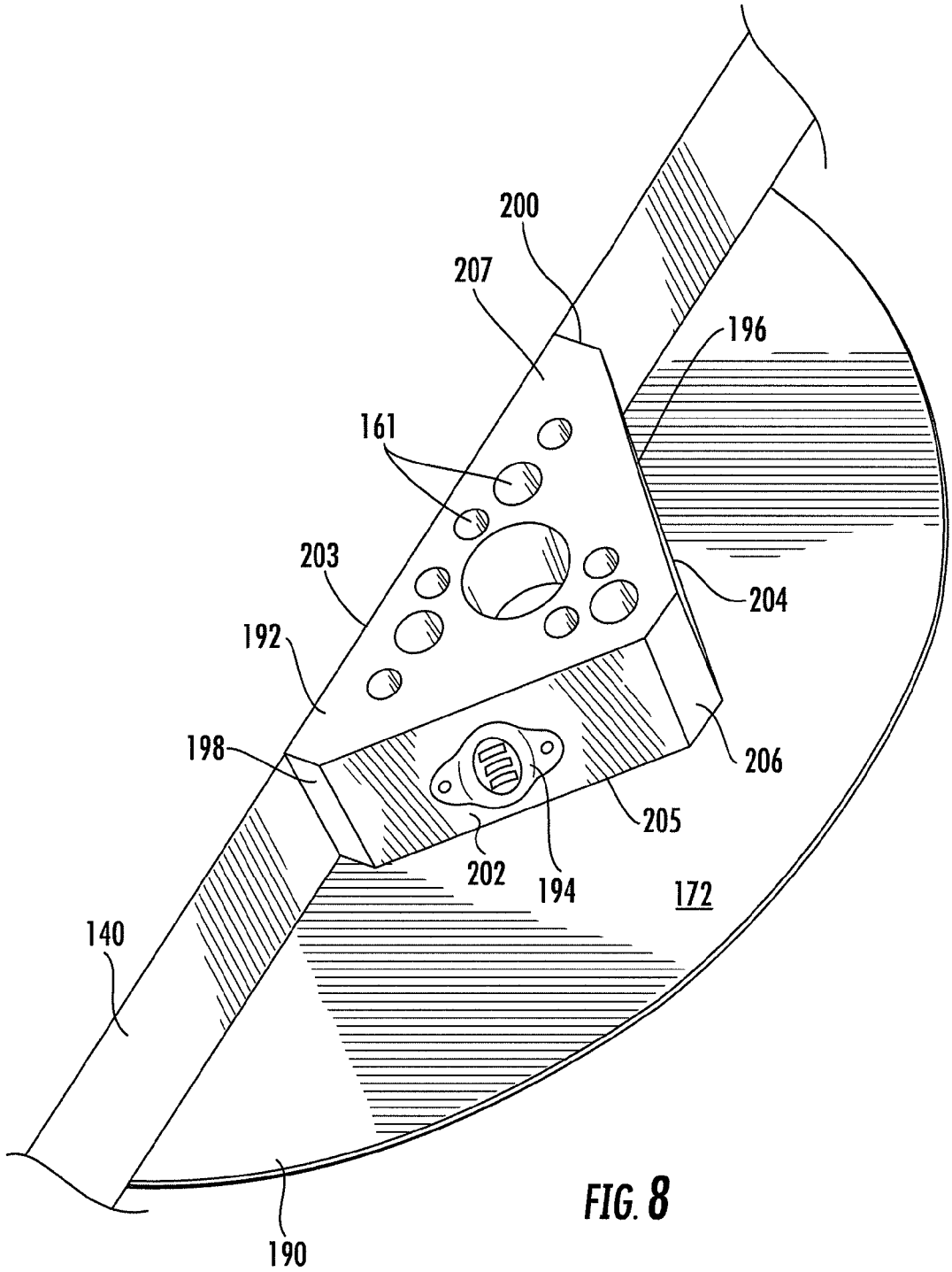
Figure 8A:
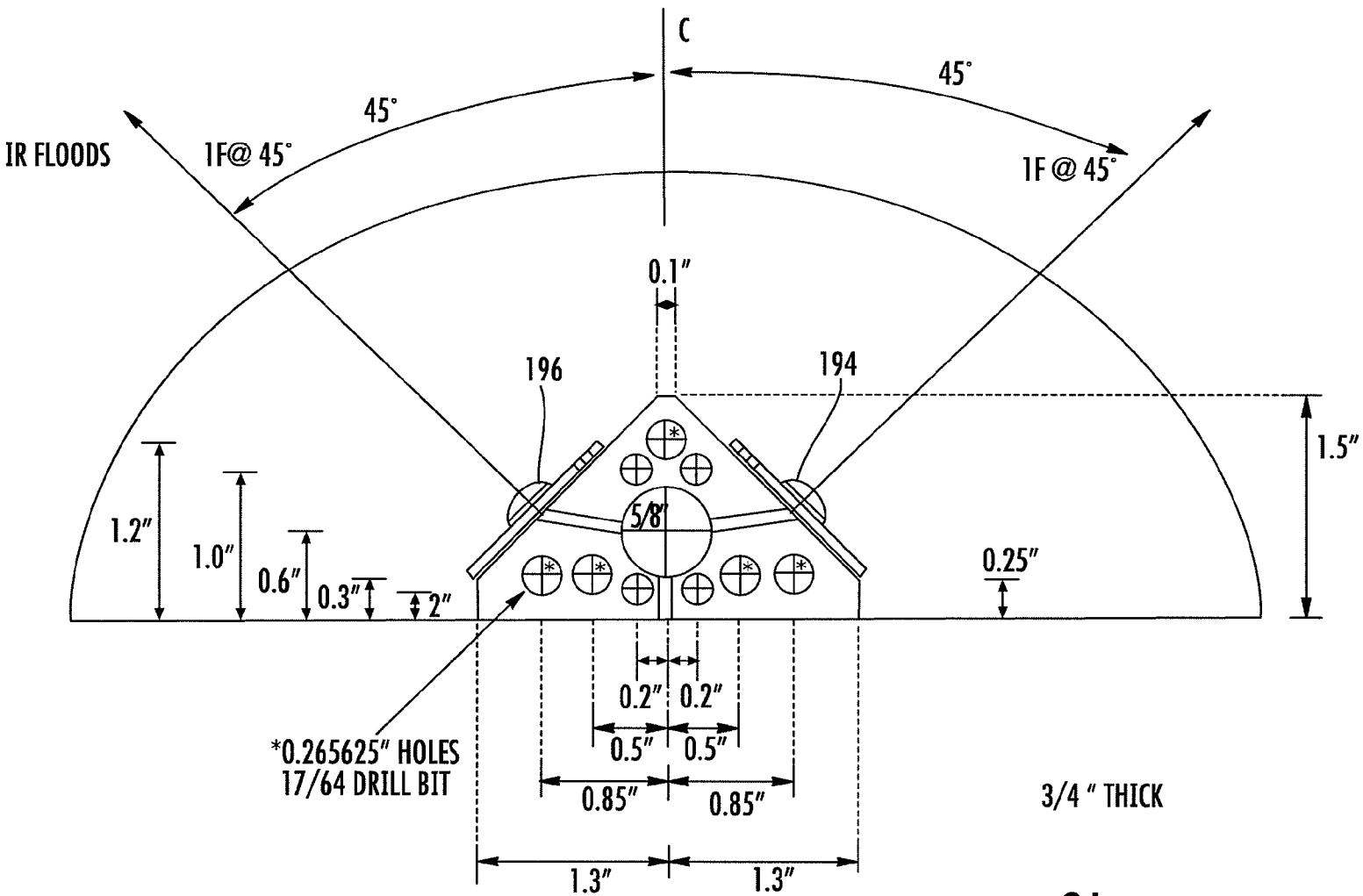
Figure 8B:
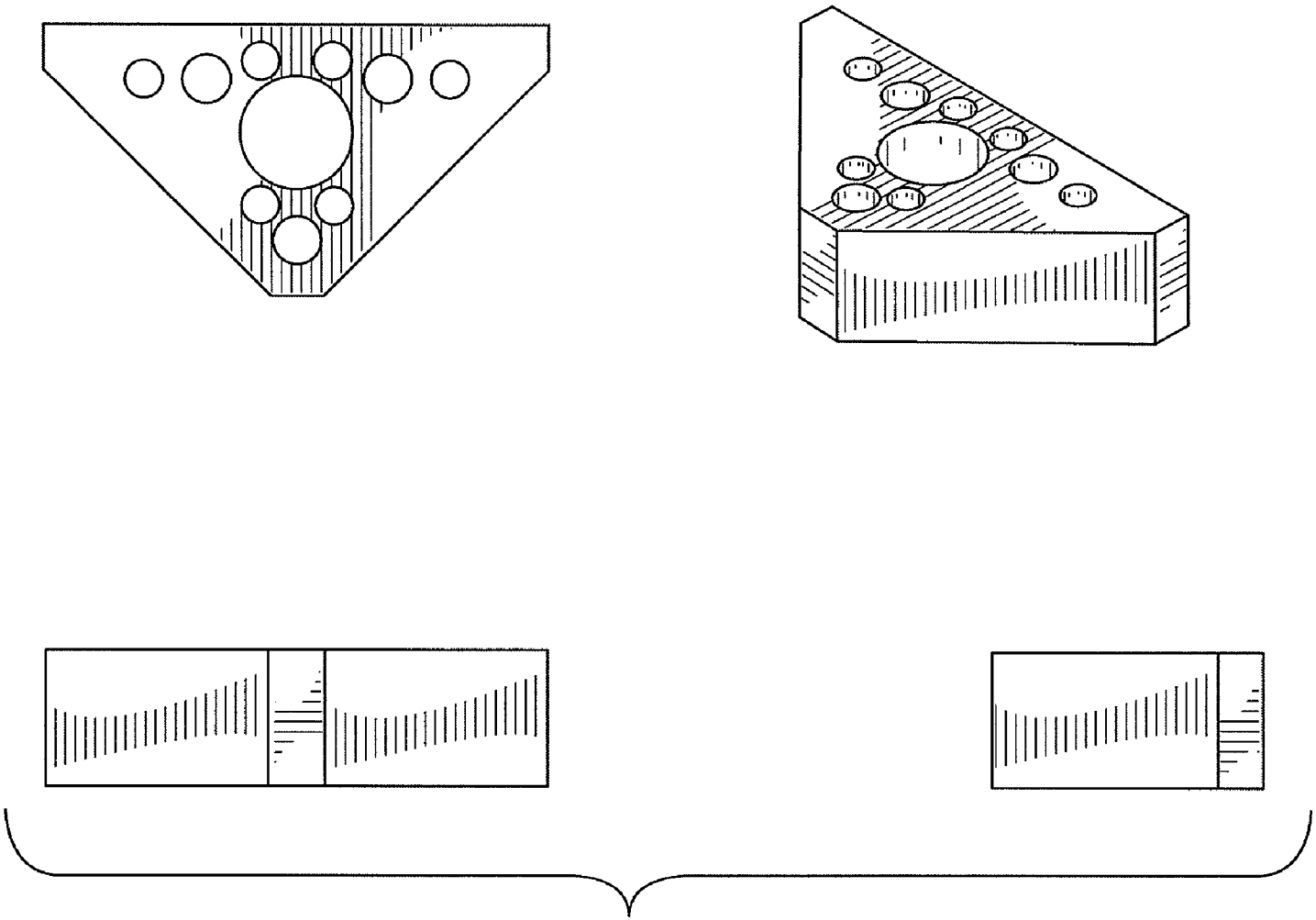
Figure 9:
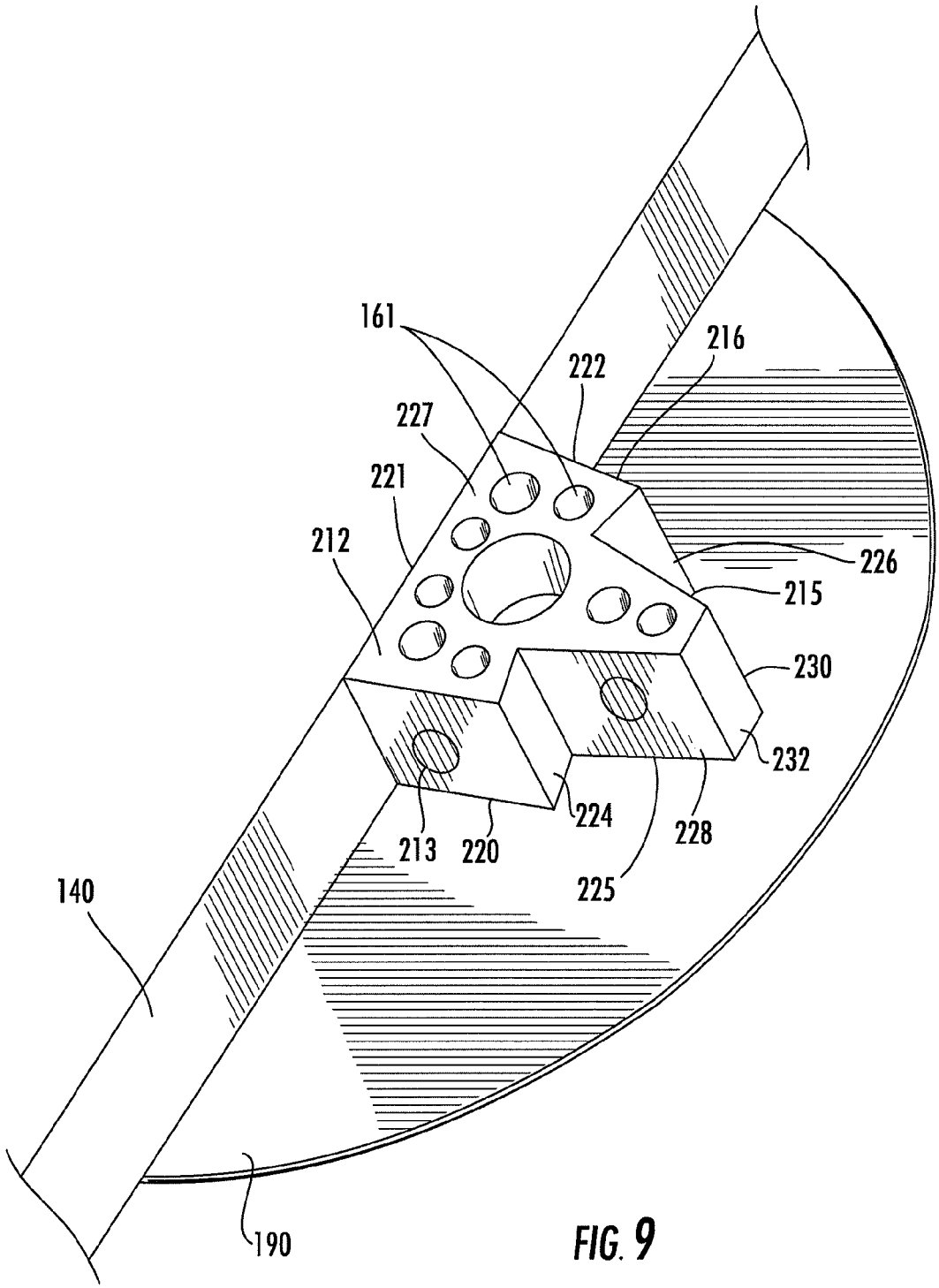
Figure 9A:
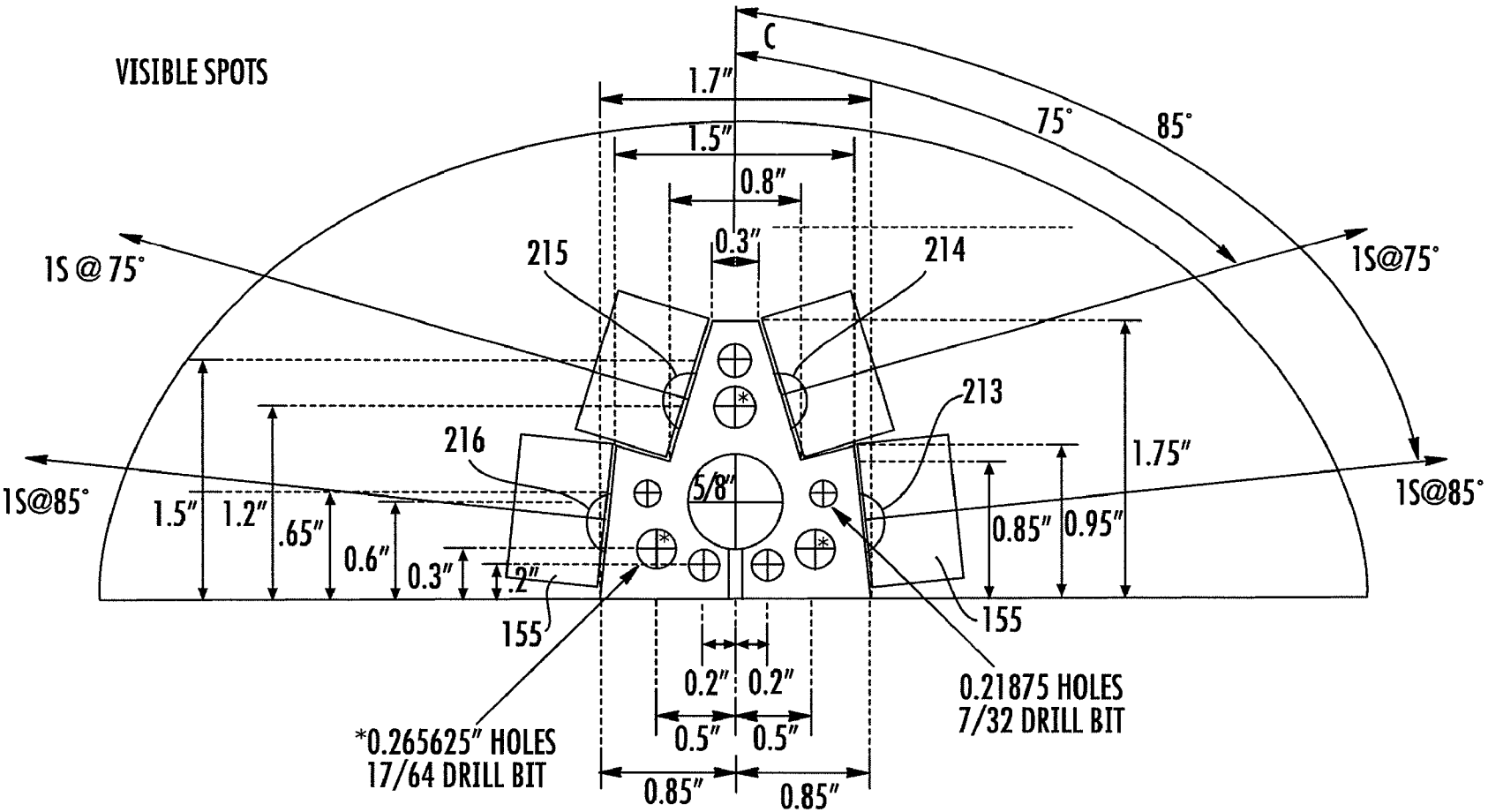
Figure 9B:
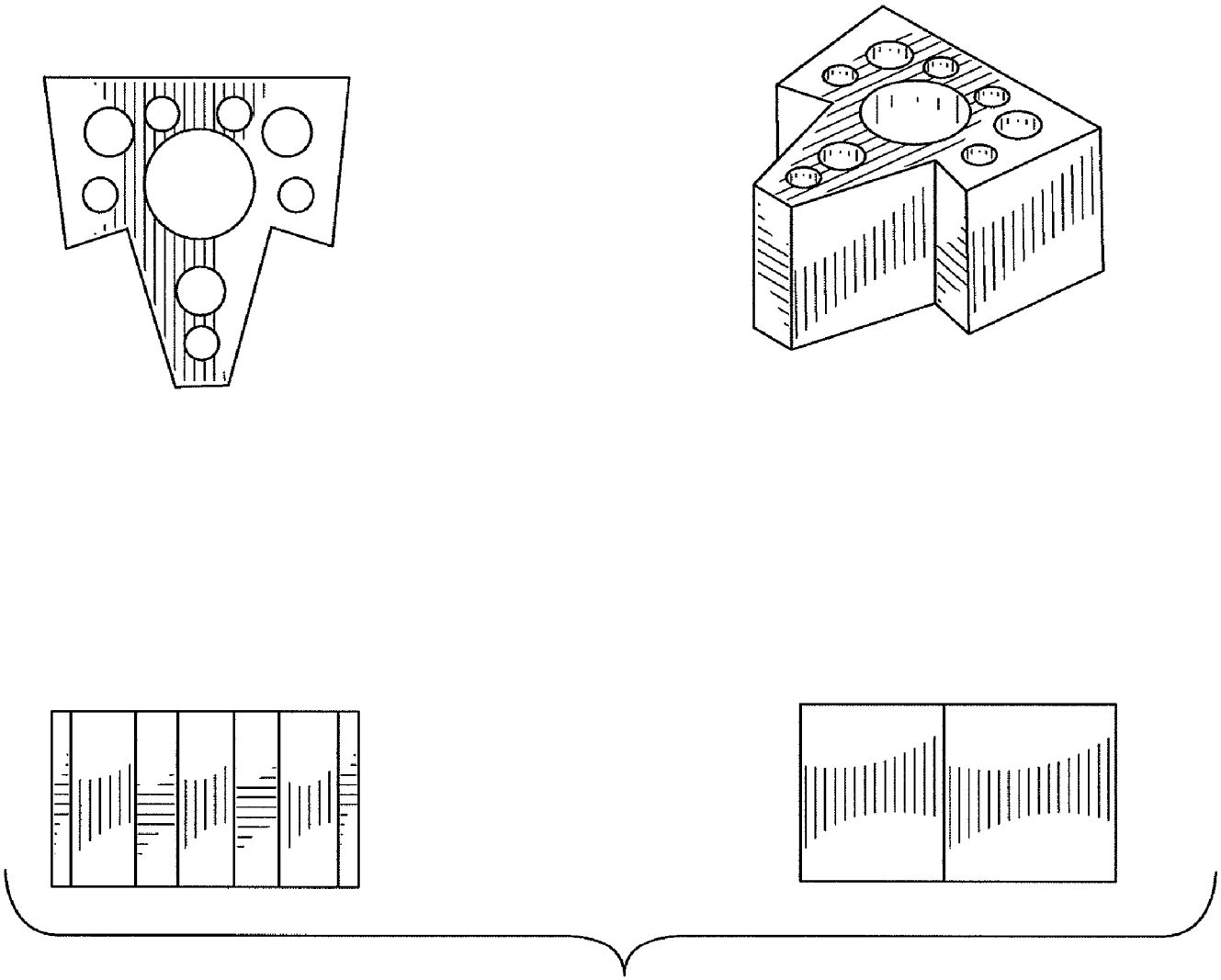
Figure 10:
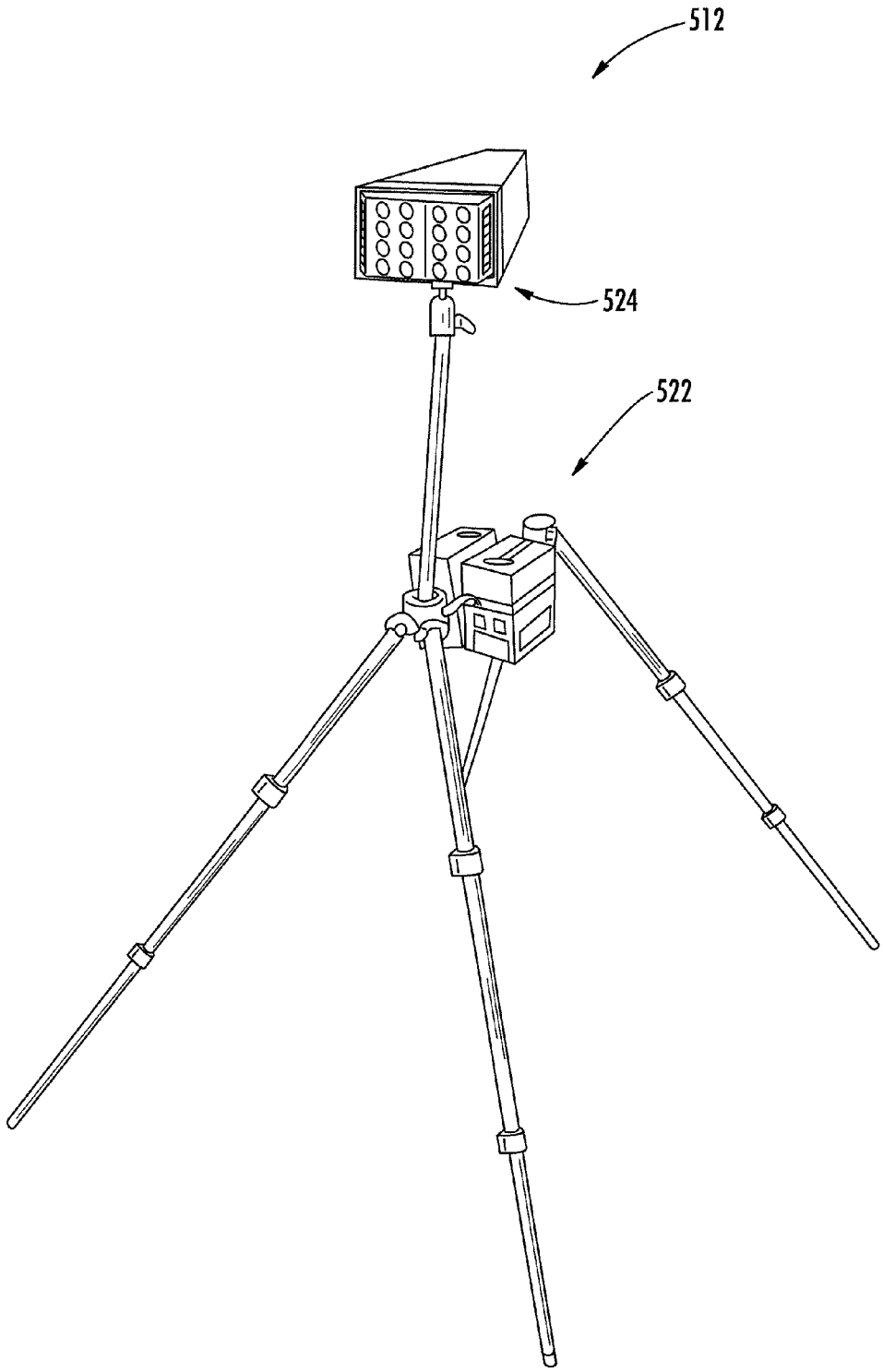
Figure 11:
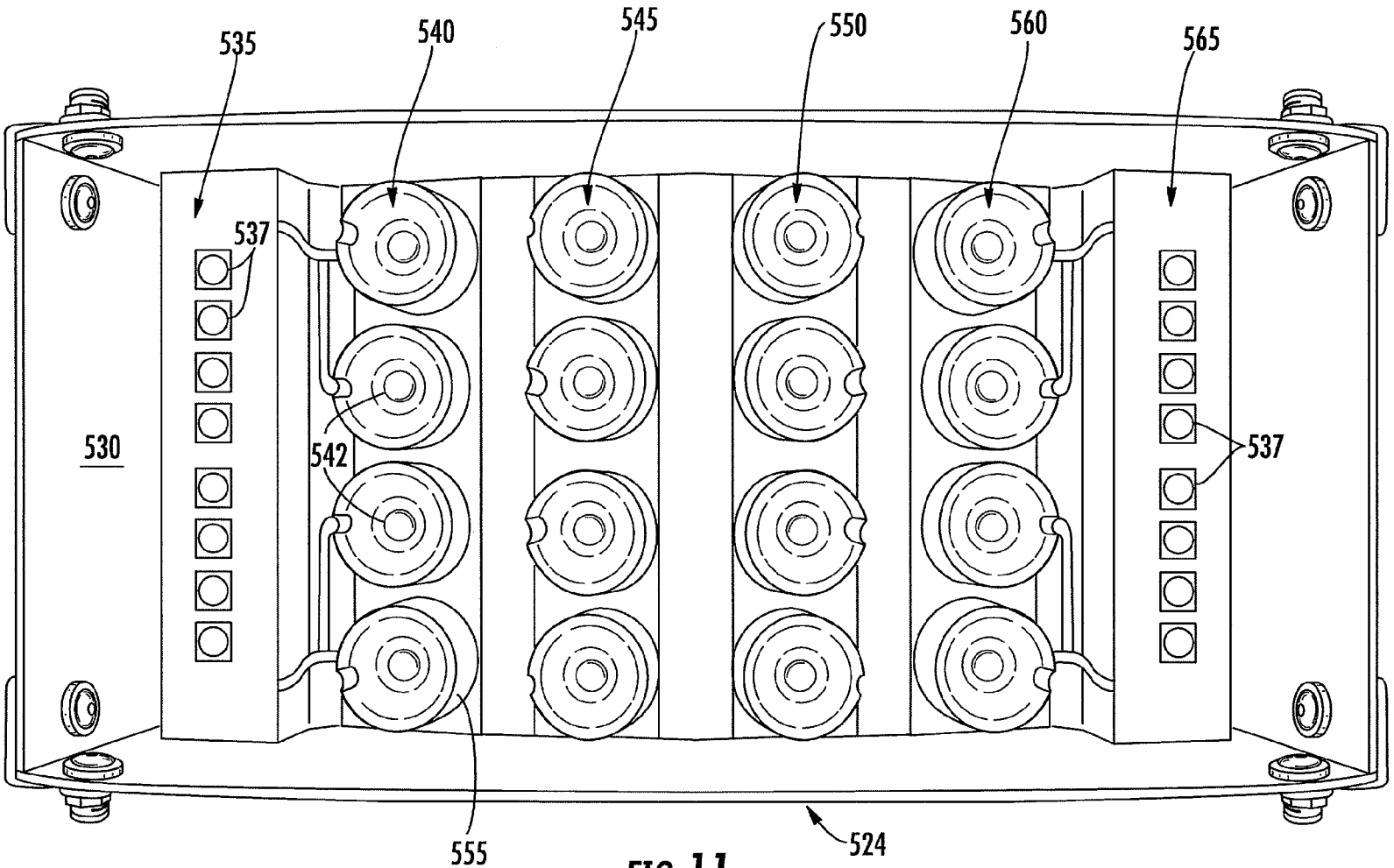
Figure 11A:
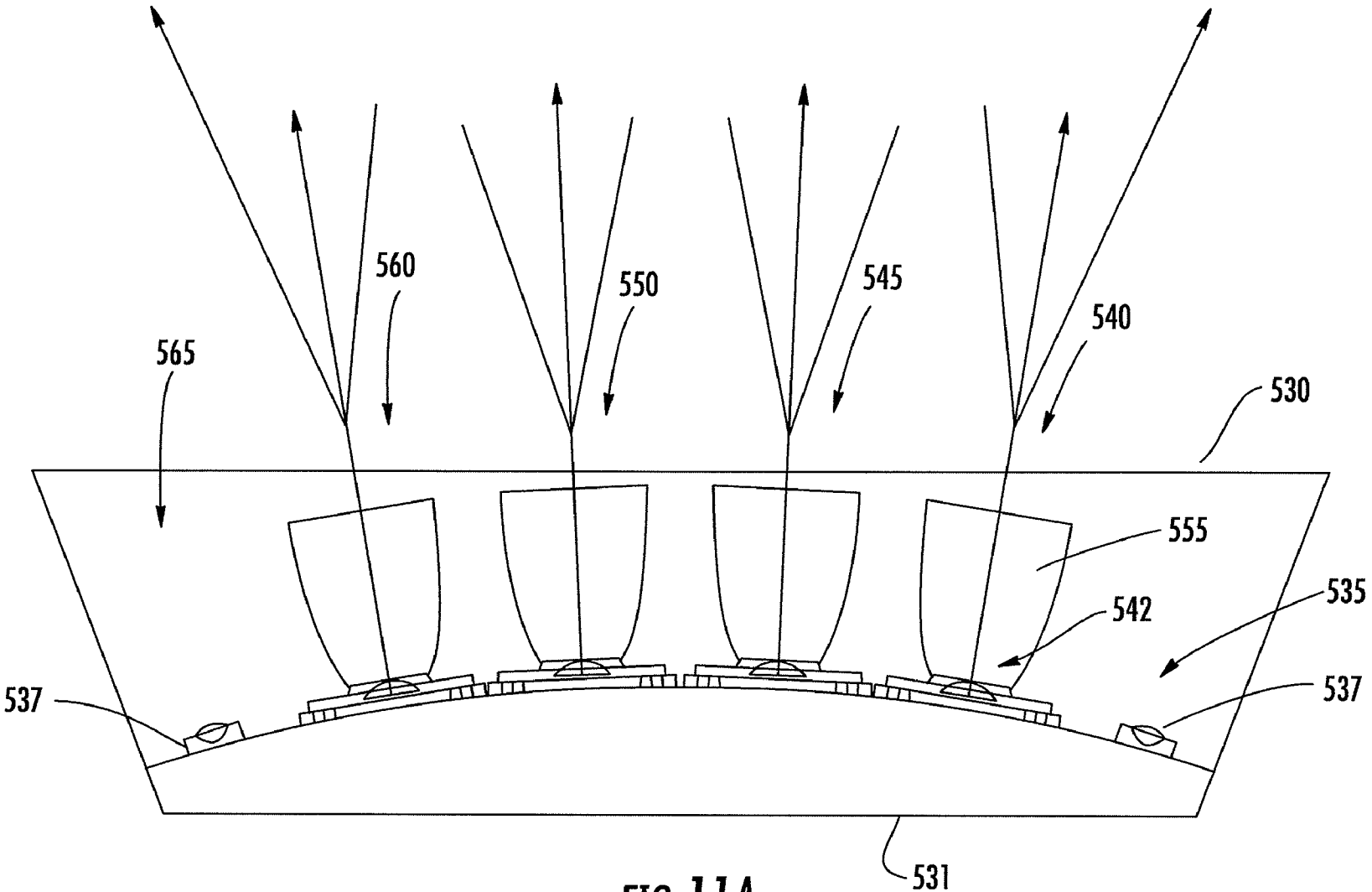
Figure 11B:
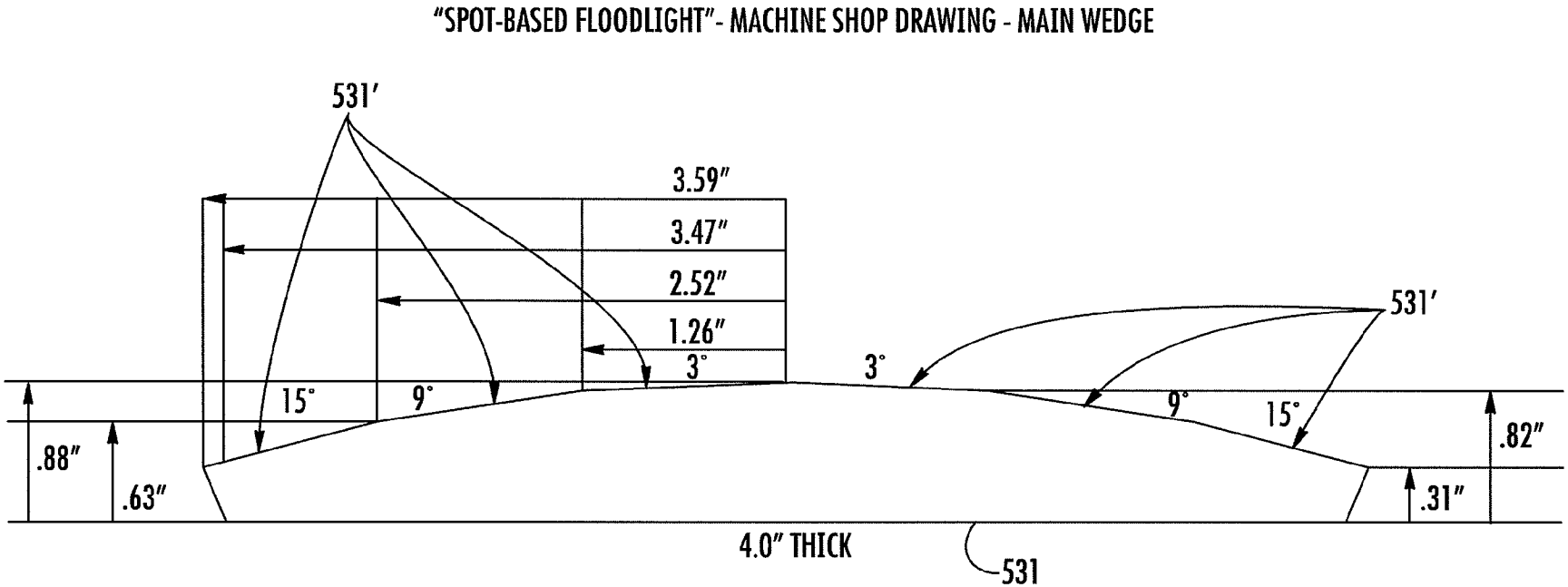
Figure 11C:
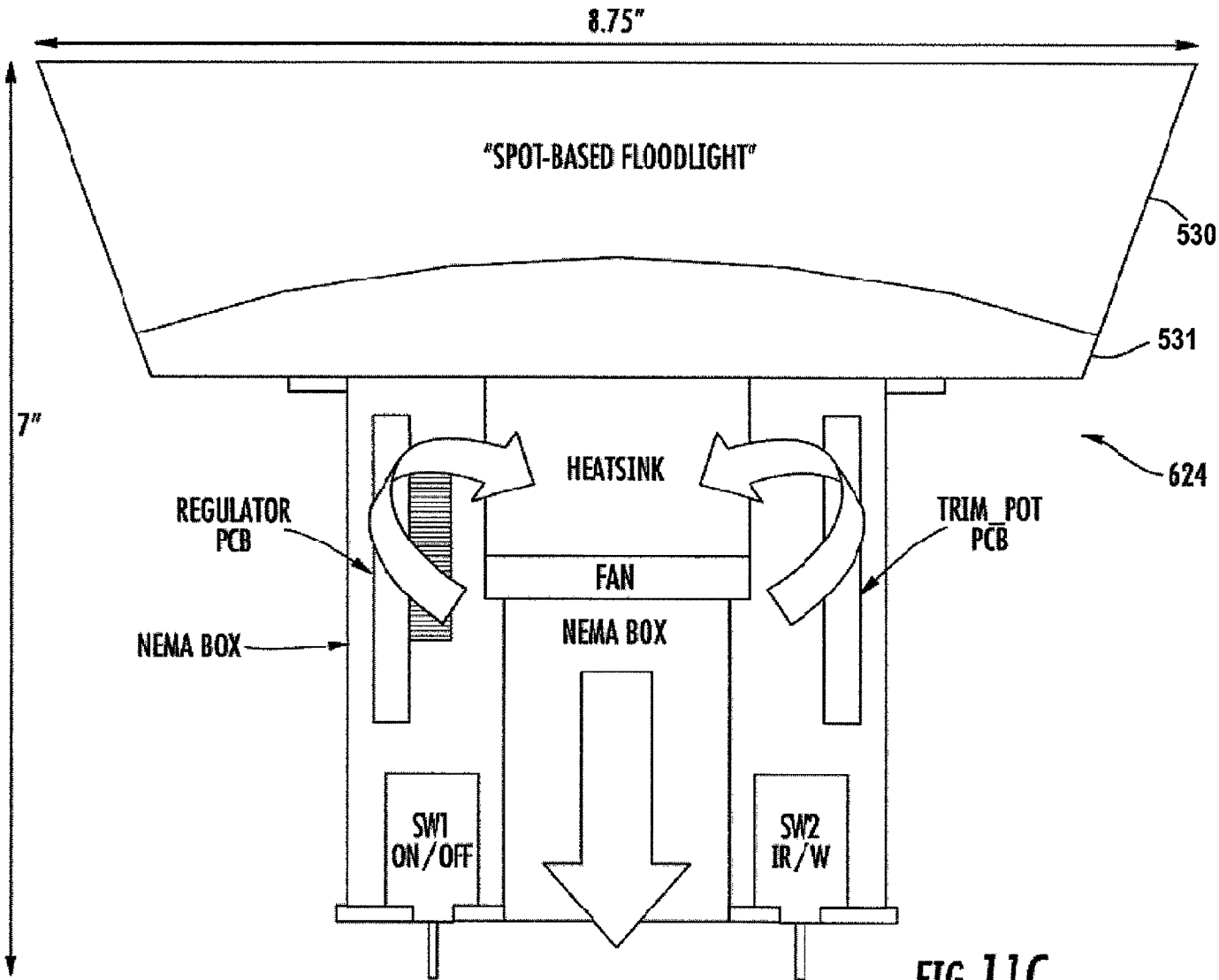
Figure 11D:
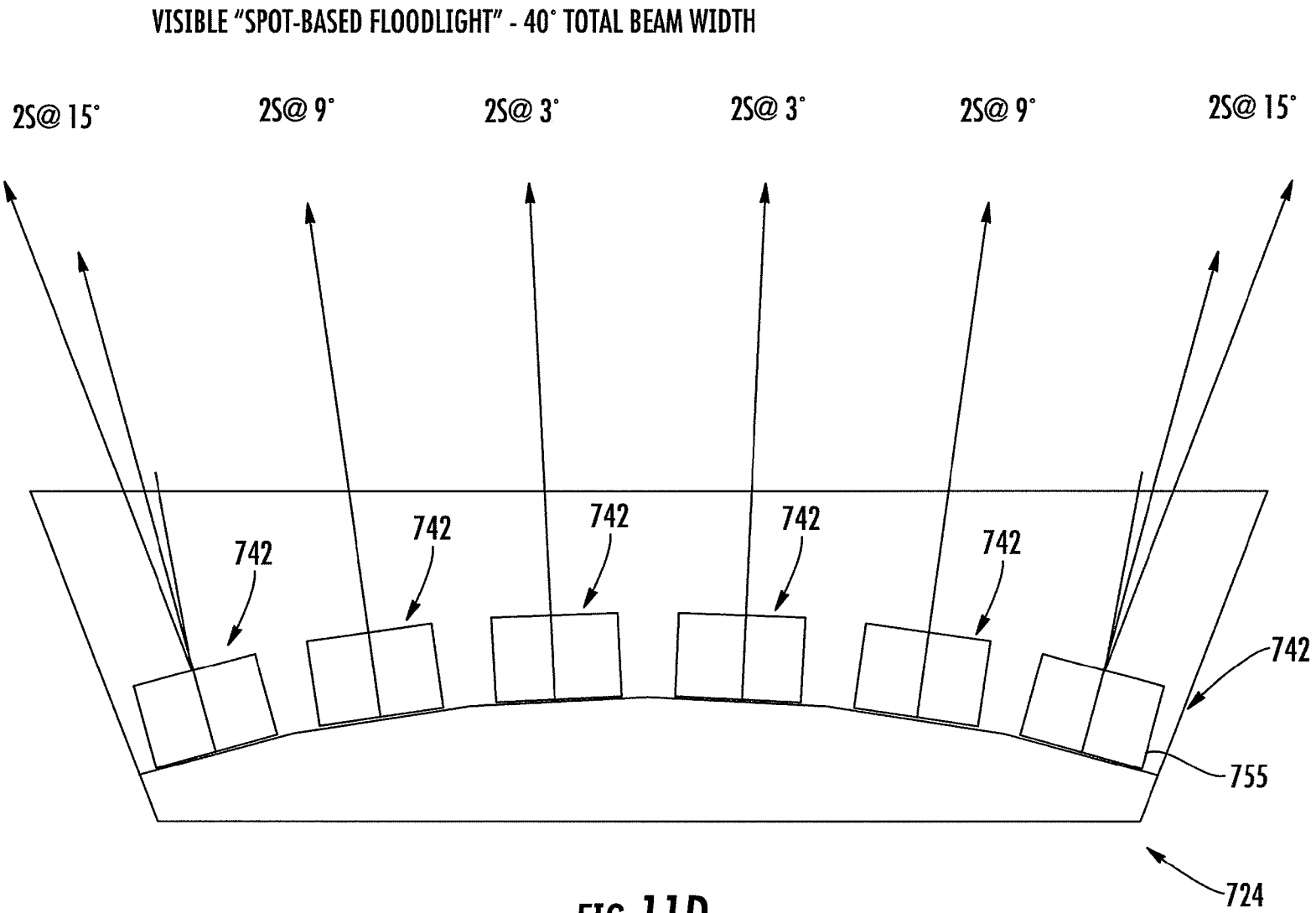
Figure 12:
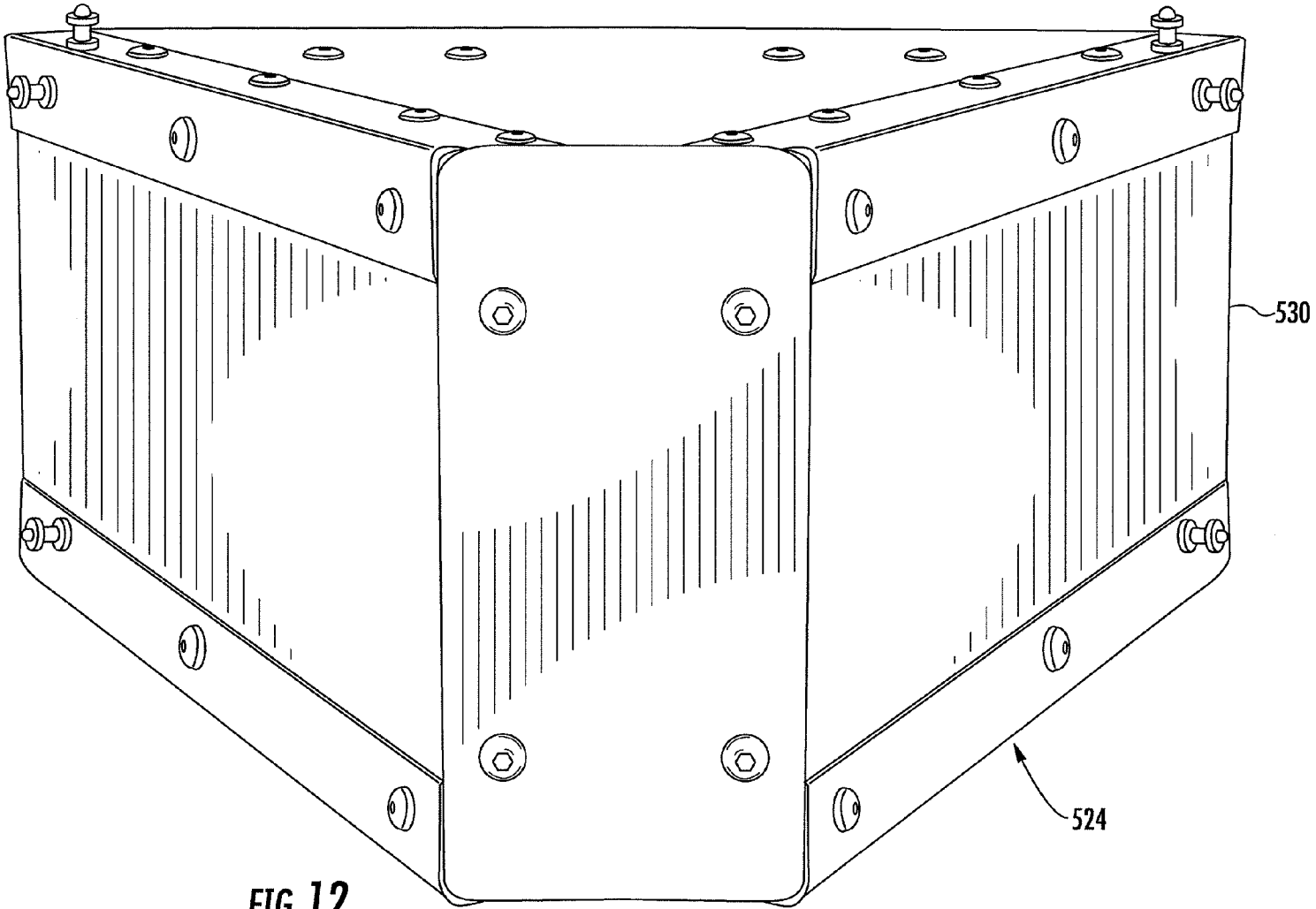
Figure 13:
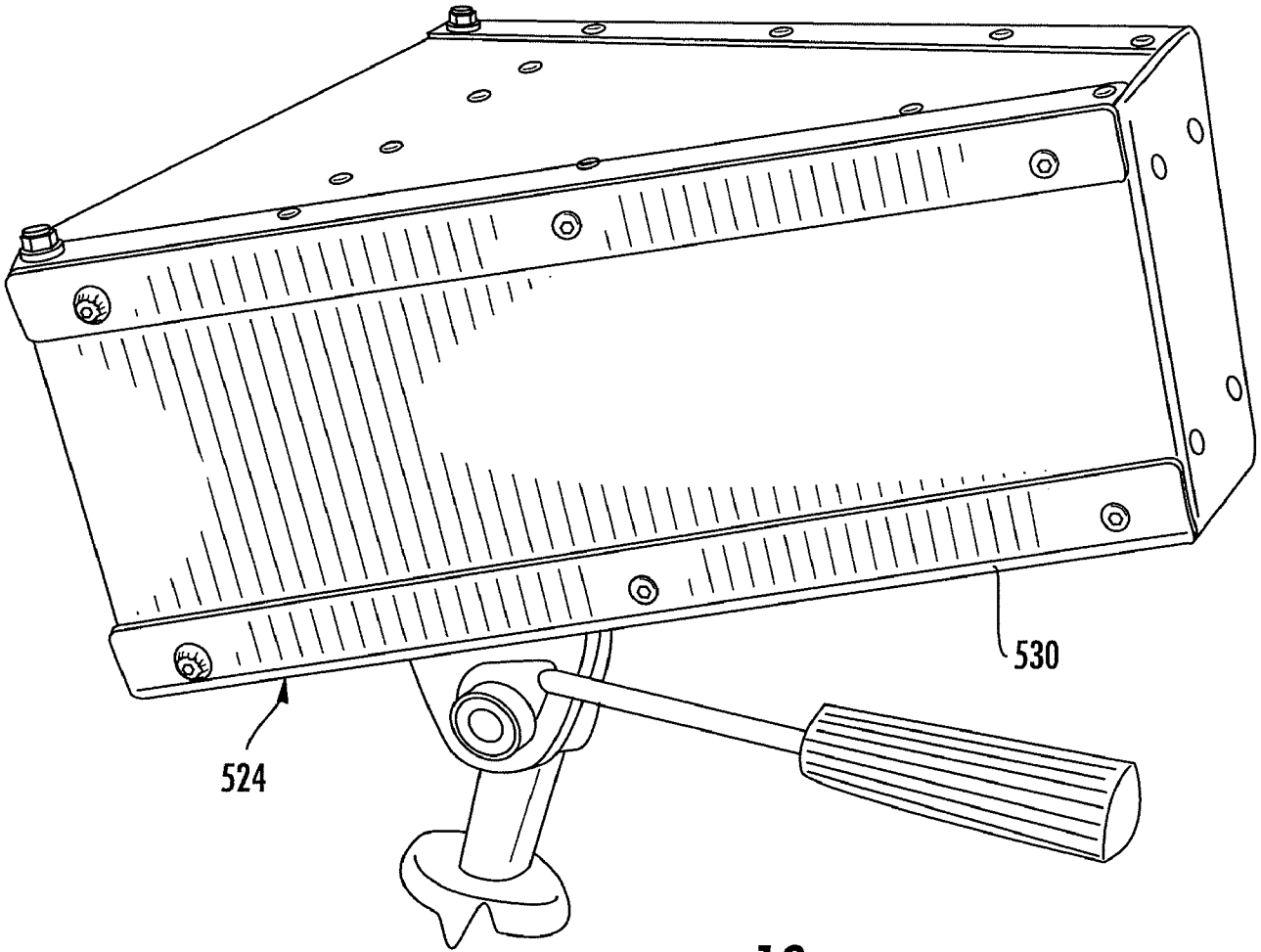
Figure 14:
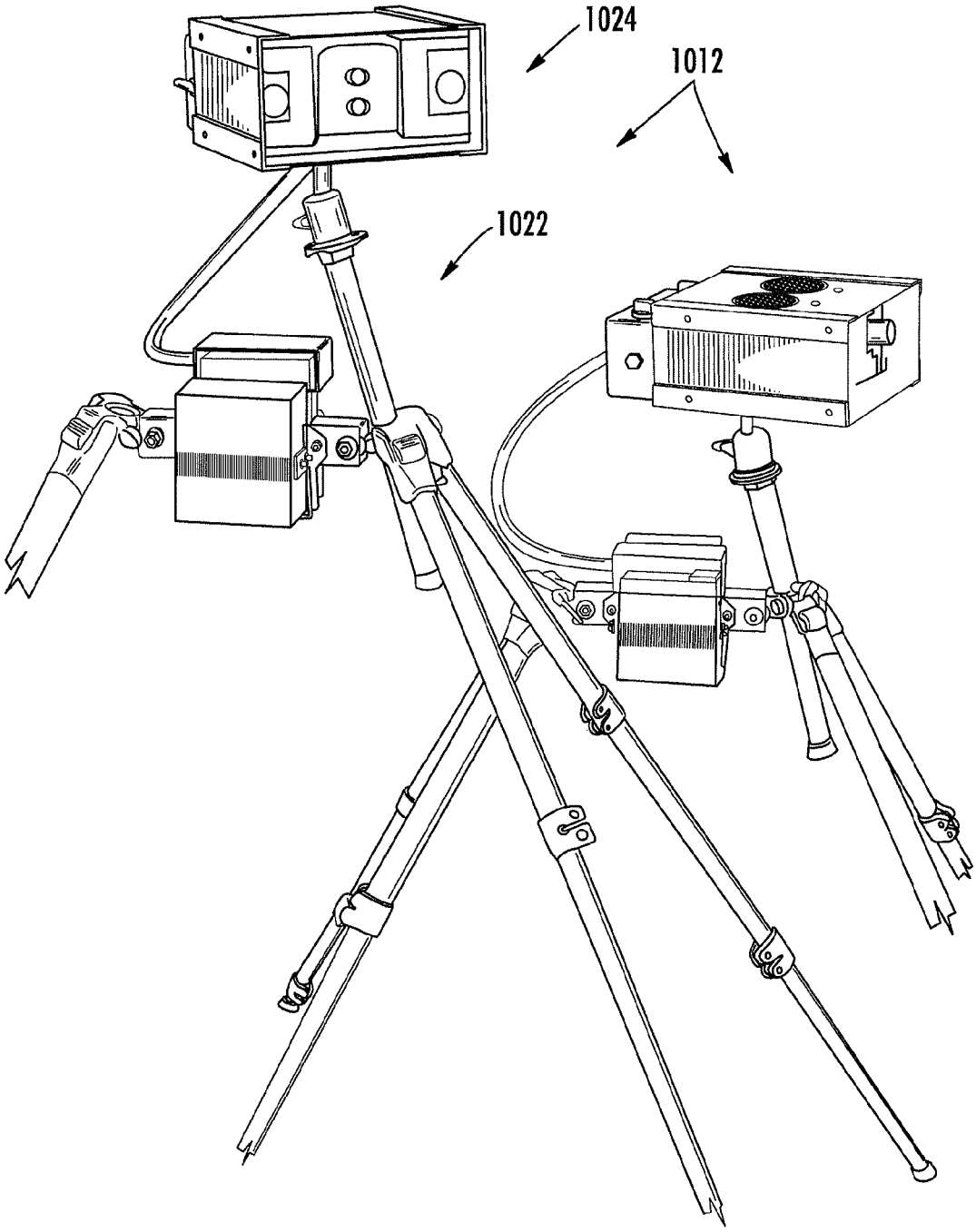
Figure 15:
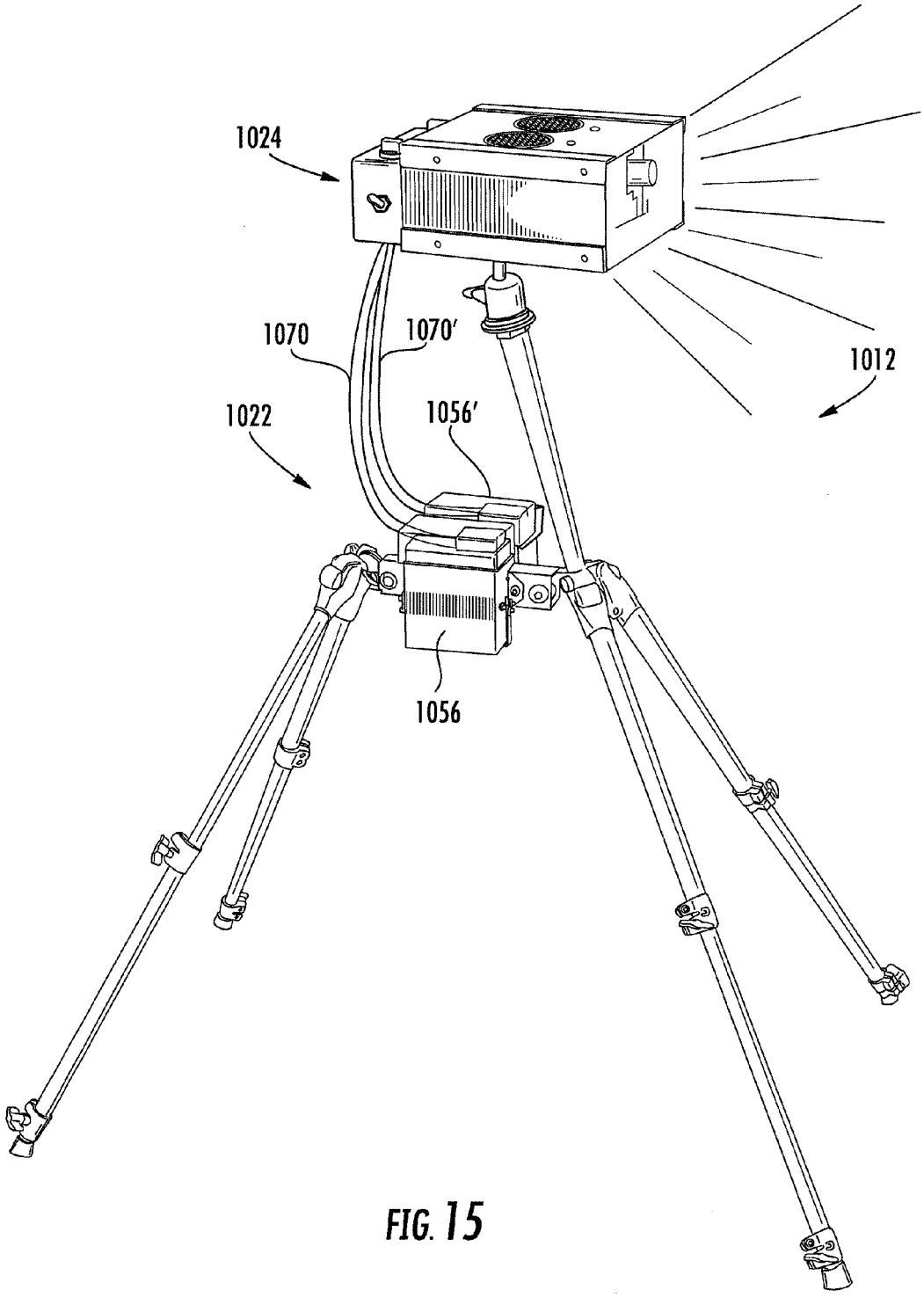
Figure 16:
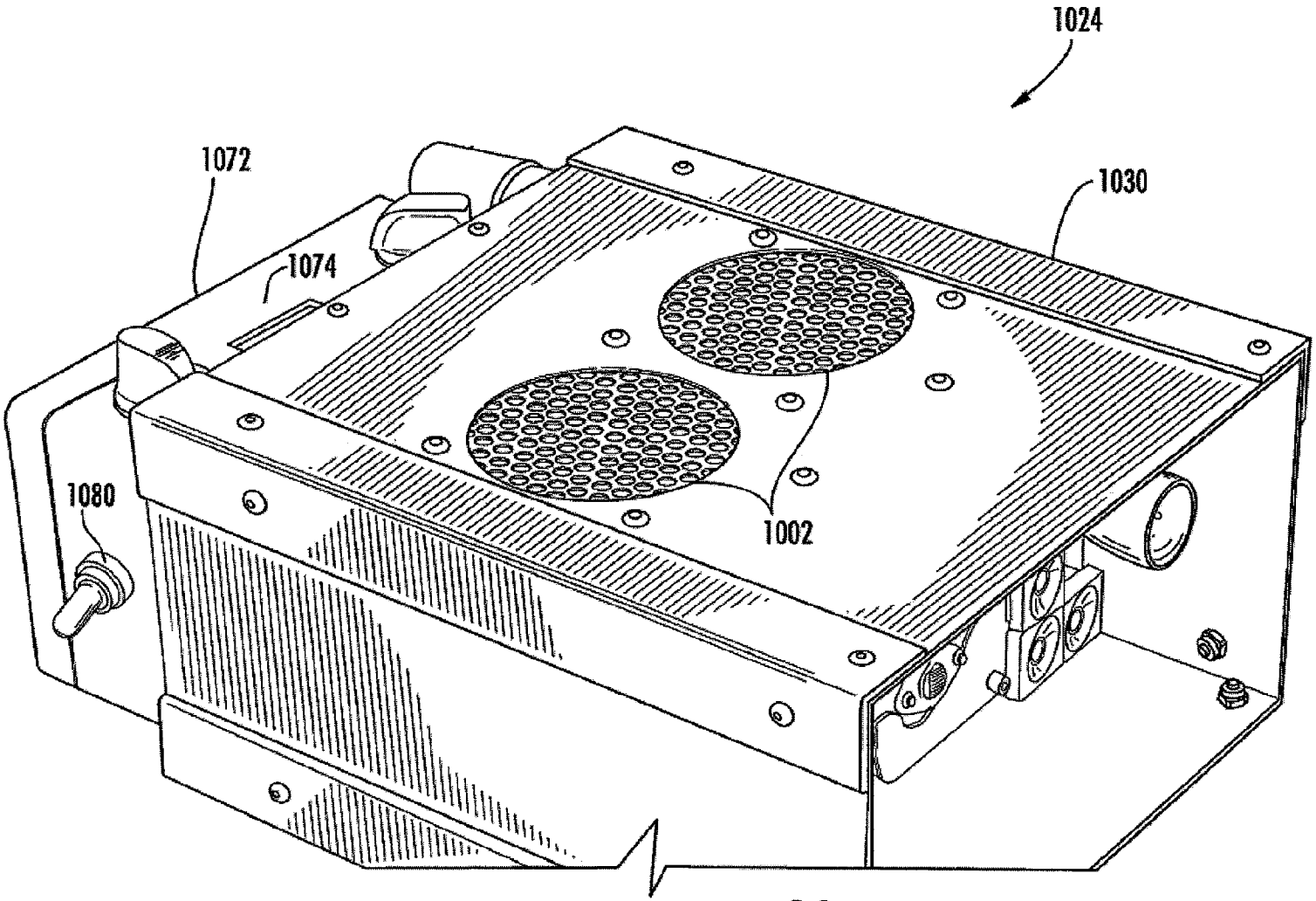
Figure 17:
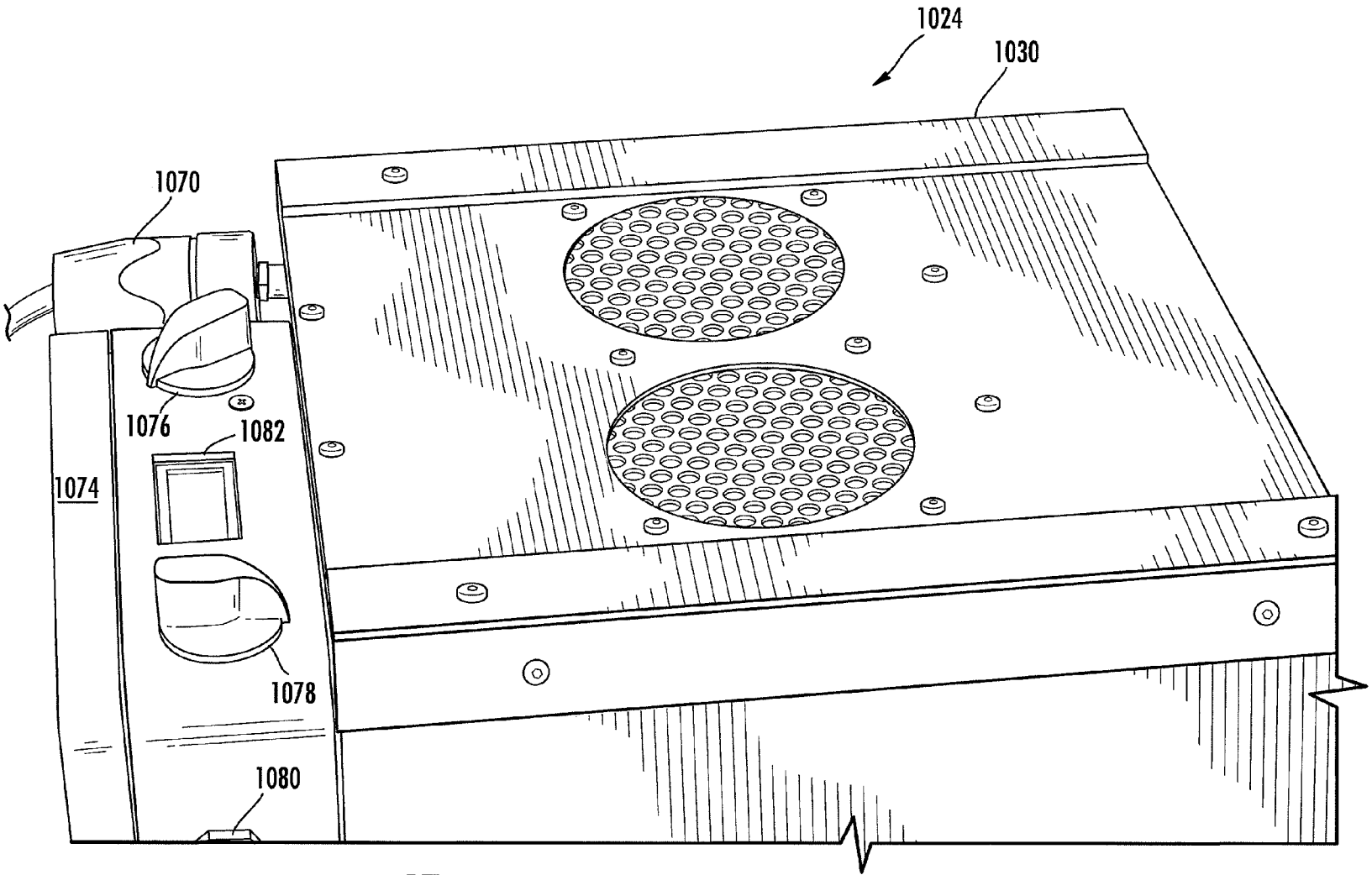
Figure 18:
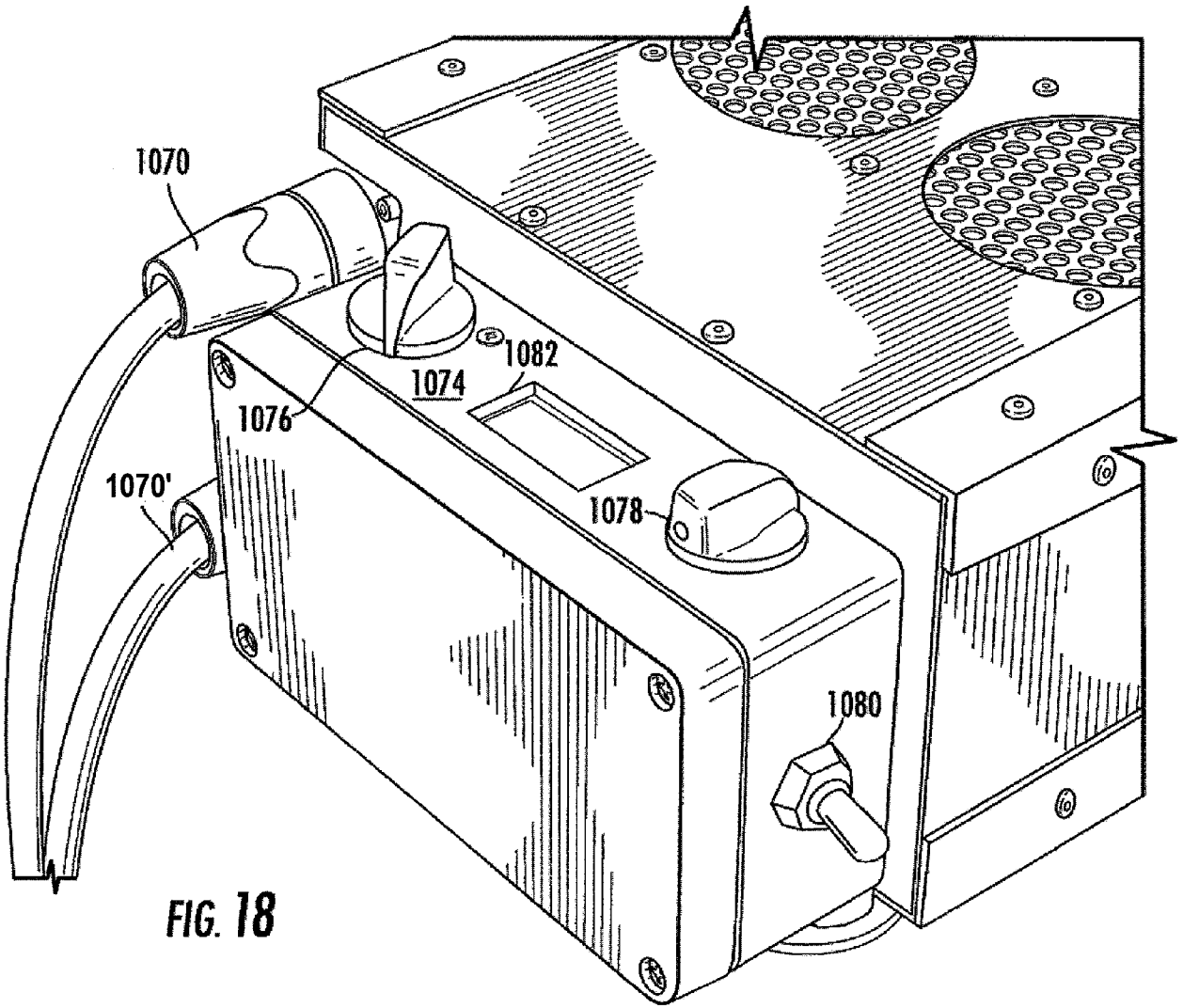
Figure 19:
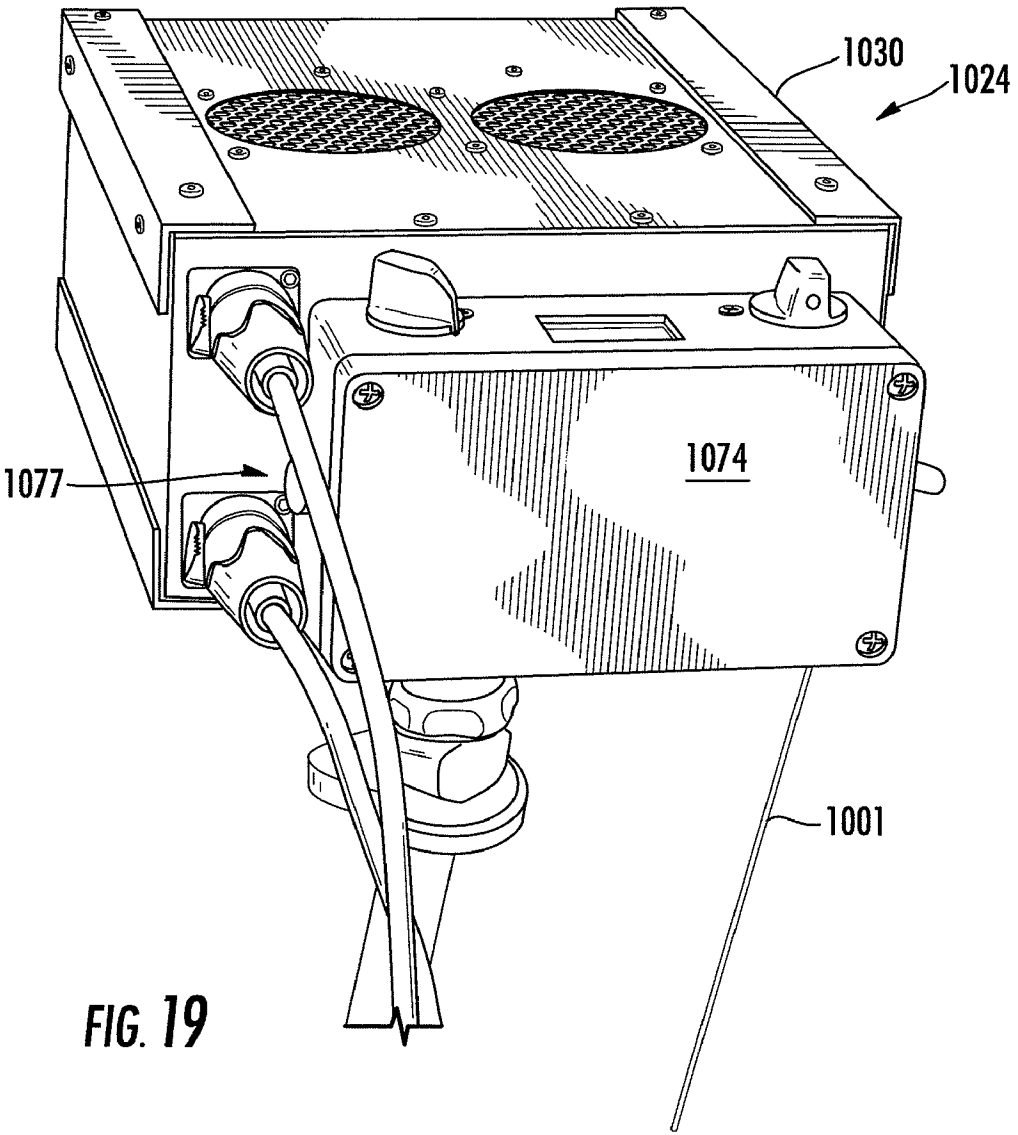
Figure 20:
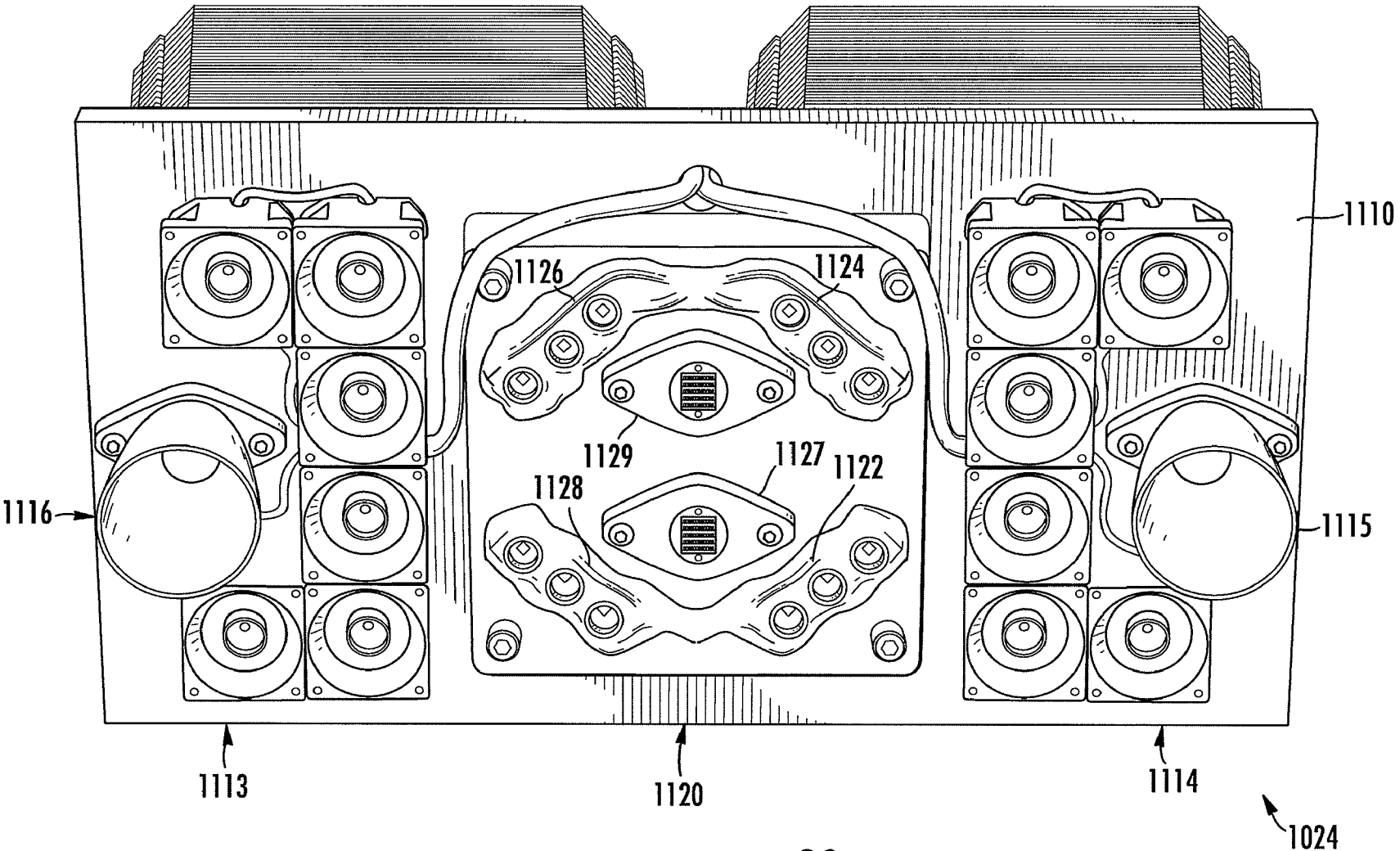
Figure 20A:
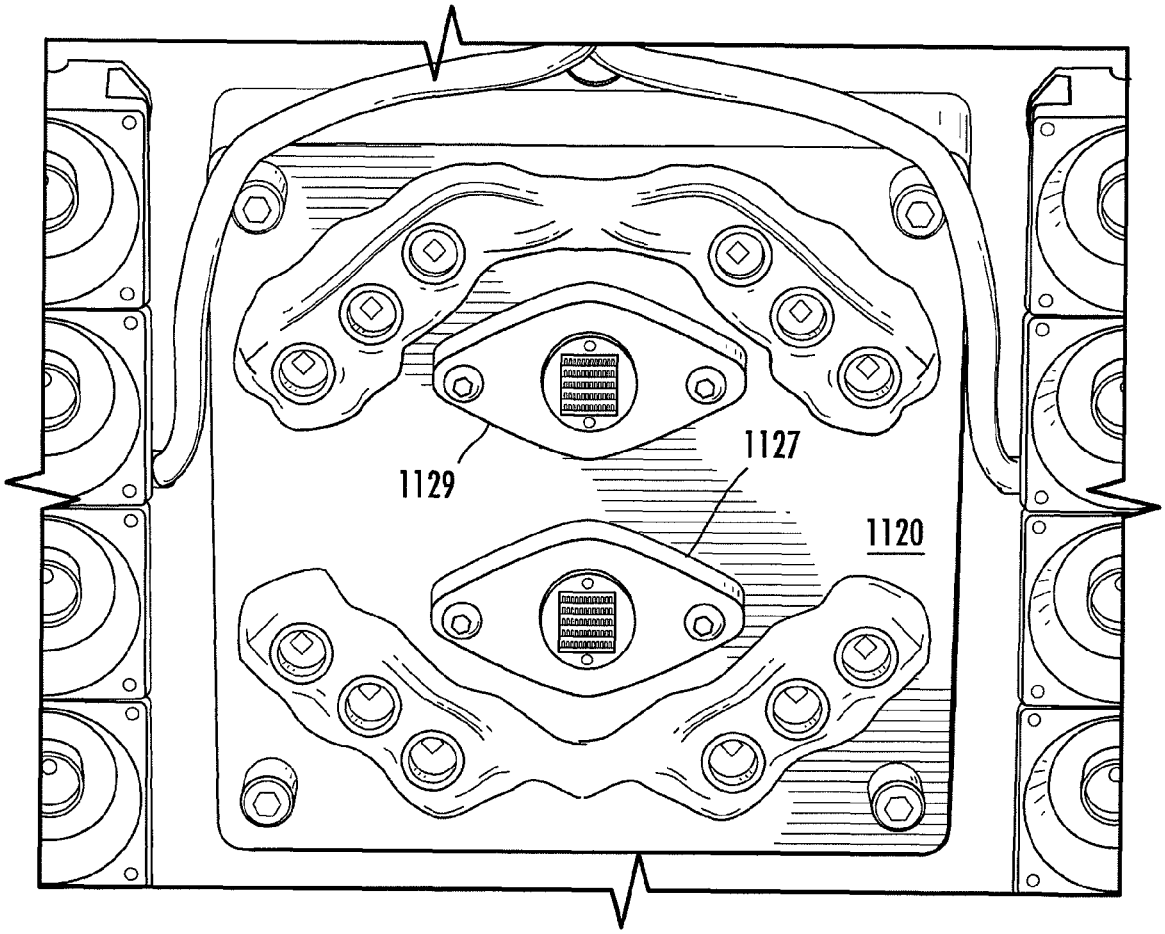
Figure 21:
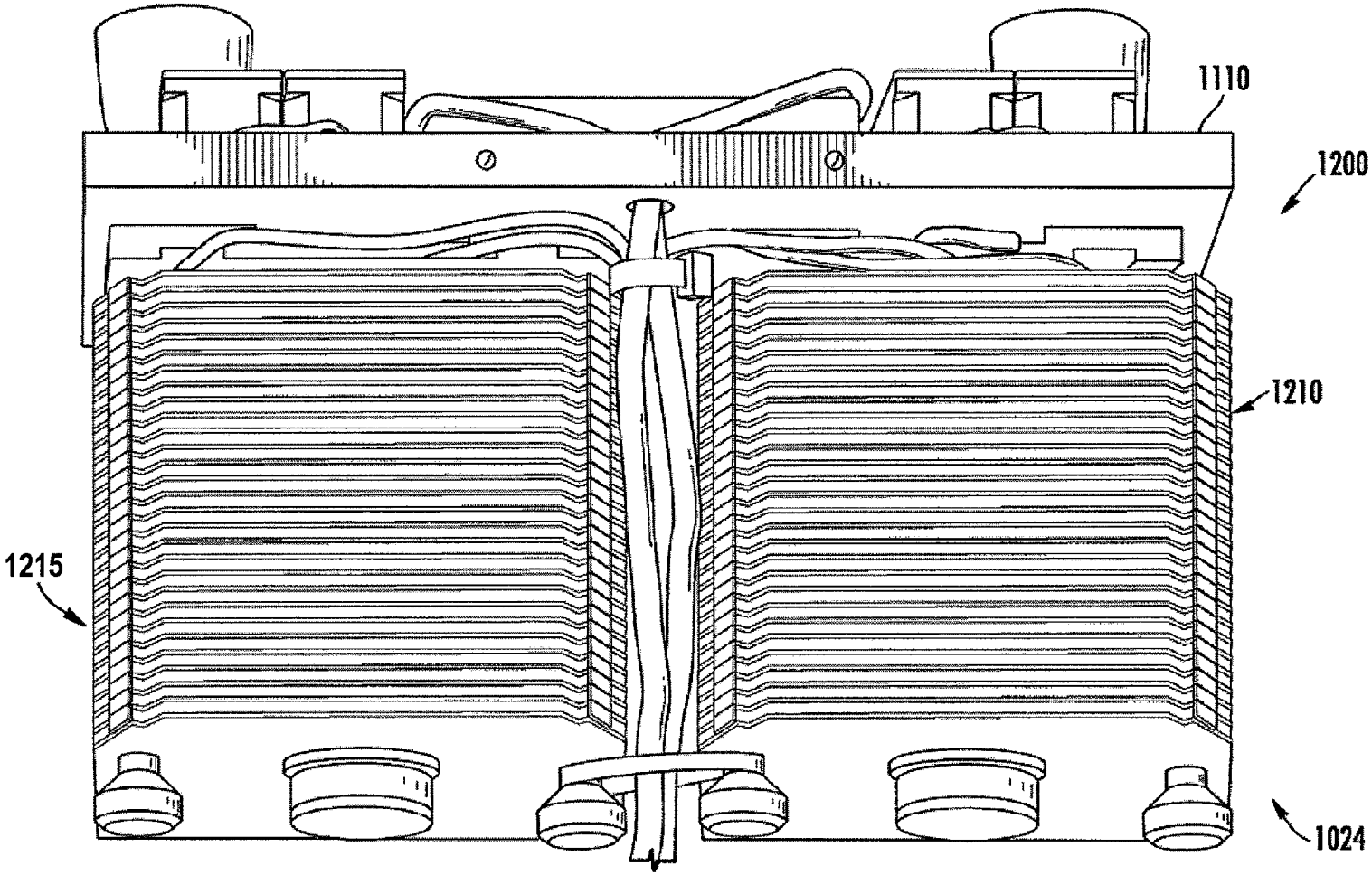
Figure 22:
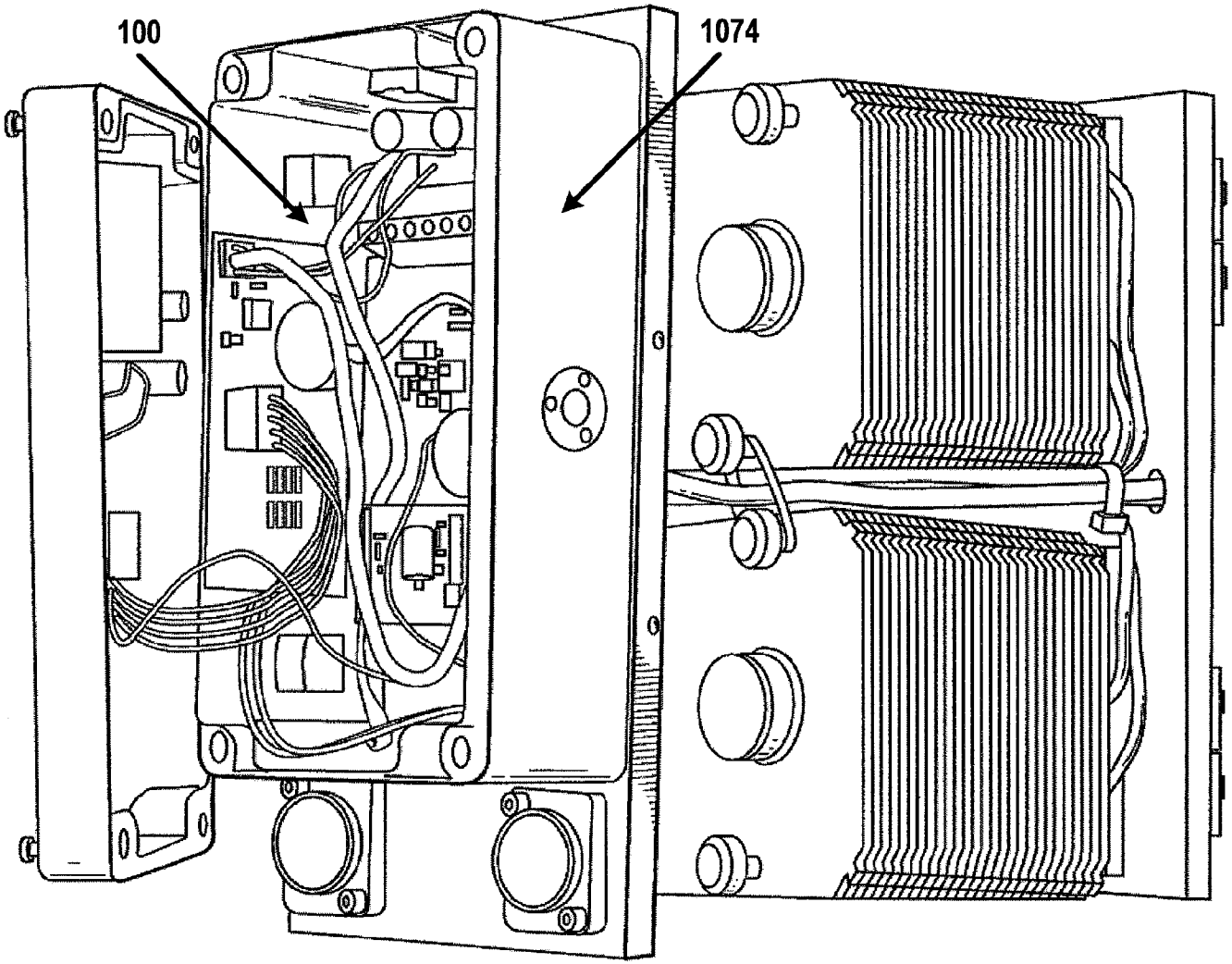

Having thus described the invention in general terms, reference will now be made to the accompanying drawings, which are not necessarily drawn to scale, and wherein:

FIG. 1 is a schematic diagram illustrating a multi-mode illumination system according to an exemplary embodiment of the present invention;

FIG. 2 is a perspective view of a lighting apparatus capable of providing a multi-mode illumination system, in accordance with one exemplary embodiment of the present invention;

FIG. 3 is a functional block diagram of an illuminating head capable of providing light for a multi-mode illumination system, in accordance with exemplary embodiments of the present invention;

FIG. 4 illustrates an electronics enclosure and user interface for a an illuminating head structured in accordance with an exemplary embodiments of the present invention;

FIG. 5 illustrates a front perspective view of an illuminating head, in accordance with an exemplary embodiment of the present invention;

FIG. 5A illustrates a detail view of an exemplary focusing device for an illuminating head structured in accordance with one embodiment of the invention;

FIG. 6 illustrates a perspective partially sectioned view of a first lighting element module structured in accordance with one embodiment of the present invention;

FIG. 6A illustrates a top view of the first lighting element module depicted in FIG. 6;

FIG. 6B illustrates four orthogonal views of a first wedge support used in the first light element module depicted in FIG. 6;

FIG. 7 illustrates a perspective partially sectioned view of a second lighting element module structured in accordance with one embodiment of the present invention;

FIG. 7A illustrates a top view of the second lighting element module depicted in FIG. 7;

FIG. 7B illustrates four orthogonal views of a second wedge support used in the second lighting element module depicted in FIG. 7;

FIG. 8 illustrates a perspective partially sectioned view of a third lighting element module structured in accordance with one embodiment of the present invention;

FIG. 8A illustrates a top view of the third lighting element module depicted in FIG. 8;

FIG. 8B illustrates four orthogonal views of a third wedge support used in the third lighting element module depicted in FIG. 8;

FIG. 9 illustrates a perspective partially sectioned view of a fourth lighting element module structured in accordance with one embodiment of the present invention;

FIG. 9A illustrates a top view of the fourth lighting element module depicted in FIG. 9;

FIG. 9B illustrates four orthogonal views of a fourth wedge support used in the fourth lighting element module depicted in FIG. 9;

FIG. 10 is a perspective view of lighting apparatus capable of providing a multi-mode illumination system, in accordance with one exemplary embodiment of the present invention;

FIG. 11 is a front view of an illuminating head structured in accordance with one embodiment of the present invention;

FIG. 11A is a top view of an illuminating head structured in accordance with one embodiment of the present invention;

FIG. 11B is a top view of a fifth wedge support for supporting LEDs structured in accordance with one embodiment of the present invention;

FIG. 11C is a schematic illustration of an illuminating head structured in accordance with one embodiment of the present invention;

FIG. 11D is a top view of an illuminating head structured in accordance with one embodiment of the present invention;

FIG. 12 is a rear view of an illuminating head structured in accordance with one embodiment of the present invention;

FIG. 13 is a perspective view of an illuminating head structured in accordance with one embodiment of the present invention;

FIG. 14 is a perspective view of two lighting apparatuses structured in accordance with one embodiment of the invention;

FIG. 15 is a side perspective view of a lighting apparatus structured in accordance with one embodiment of the invention;

FIG. 16 is a top perspective view of an illuminating head of a lighting apparatus structured in accordance with one embodiment of the invention;

FIG. 17 is another top perspective view of the illuminating head depicted in FIG. 16;

FIG. 18 is a top perspective view of the illuminating head depicted in FIG. 16;

FIG. 19 is a rear perspective view of the illuminating head depicted in FIG. 16;

FIG. 20 is a front perspective view of the illuminating head depicted in FIG. 16 with the illuminating head housing removed;

FIG. 20A is a front detail view of the illuminating head depicted in FIG. 20;

FIG. 21 is a detail view of a cooling system for an illuminating head structured in accordance with one embodiment of the invention; and FIG. 22 is a rear partially exploded view of an illuminating head structured in accordance with one embodiment of the invention.

DETAILED DESCRIPTION OF THE INVENTION

The present invention will now be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

FIG. 1 is a schematic diagram illustrating a multi-mode illumination system 10 structured according to one embodiment of the present invention. As shown, the system 10 may include at least one lighting apparatus 12 disposed proximate to an asset 14, which in the present example is an aircraft. The lighting apparatus 12 is an illuminating device that is structured to illuminate a desired sector. For example, during operation, the lighting apparatus 12 defines a darkened zone 16 in which light emitted by the lighting apparatus 12 is shielded and an illuminated zone 18 in which light emitted by the lighting apparatus 12 is not shielded. In the depicted embodiment, the darkened zone 16 defines approximately a 180 degree rear sector of the lighting apparatus 12, while the illuminated zone 18 defines about a 180 degree front sector of the lighting apparatus 12. It should be noted that, although the present embodiments is configured to illuminate a sector of about 180 degrees, other arrangements are also possible.

The lighting apparatus 12 is oriented with respect to the asset 14 such that a perimeter 20 is defined around the asset 14. The perimeter 20 is defined by a boundary between the darkened zone 16 and the illuminated zone 18. Thus, the perimeter may define a selected shape around the asset 14 separating areas outside of the perimeter 20 (i.e., areas disposed in the illuminated zone 18), which are illuminated by the lighting apparatus 12 from areas inside the perimeter 20 (i.e. areas disposed in the darkened zone 16), which are not illuminated by the lighting apparatus 12. An arrangement of more than one lighting apparatus 12 will determine the shape of the perimeter 16. For example, as shown in FIG. 1, four lighting apparatuses 12 disposed equidistant from a center of the asset 14 and oriented such that the darkened zone 16 of each of the lighting apparatuses 12 faces the asset 14 creates a square shaped perimeter 20. It should be noted that the perimeter 20 need not be defined around an aircraft as shown in FIG. 1. Rather the asset 14 could be any object, group of objects, or geographic location.

The illuminated zone 18 may be illuminated with light of any selected frequency range. In an exemplary embodiment, the lighting apparatus 12 illuminates the illumination zone 18 with visible (e.g., white) light and/or infrared (IR) light. Meanwhile, the illumination zone 18 may be illuminated with flood lights and/or spot lights. Furthermore, the illumination zone 18 may be illuminated with any combination of visible and/or IR lights operating as flood lights and/or spot lights. The depicted lighting apparatus 12 includes four light modules (see FIG. 4) including IR flood, IR spot, visible flood and visible spot. Any single module of the four light modules may be activated to operate with or without any combination of the remaining modules. Accordingly, for this exemplary embodiment, the lighting apparatus 12 may have $2^4$ or sixteen modes since there are two possible states for each of the four light modules.

FIG. 2 is a perspective view of the lighting apparatus (shown in FIG. 1 as item 12), which is capable of use for providing the multi-mode illumination system (shown in FIG. 1 as item 10), in accordance with one exemplary embodiment of the present invention. The depicted lighting apparatus includes a mounting apparatus 22 and a multi-mode illuminating head 24 (referred to hereinafter as the illuminating head 24). Components of the mounting apparatus 22 may be made from any suitable material. In an exemplary lightweight embodiment, the mounting apparatus 22 may be made from materials such as aluminum, plastic, combinations thereof, or other light-weight and durable materials. When fully assembled, as shown in FIG. 2, the mounting apparatus 22 forms a stable mounting platform for the illuminating head 24 and may be referred to herein as a "quad-pod". In various exemplary embodiments, a total weight of the illuminating head 24 and the mounting apparatus 22 combined is less than fifteen pounds, preferably less than ten pounds, and more preferably less than about 8 pounds.

The depicted mounting apparatus 22 includes a first leg assembly 30, a second leg assembly 32 and a bridge assembly 34. In operation, the first leg assembly 30 is disposed at one end of the bridge assembly 34 while the second leg assembly 32 is disposed at the opposite end of the bridge assembly 34. Each of the leg assemblies 30 and 32 includes two legs 36. Each of the legs 36 may include one or more segments as shown. In an exemplary embodiment, as shown in FIG. 2, each of the legs 36 include a first segment 38, a second segment 40 and a third segment 42, which are telescopically extendable. More particularly, the first segment 38 is disposed closest in proximity to the bridge assembly 34 and is formed substantially as a cylindrical tube having a larger diameter than both the second and third segments 40 and 42. The second segment 40 is telescopically extendable to be disposed between the first and third segments 38 and 42. The second segment 40 is formed substantially as a cylindrical tube having a larger diameter than the third segment 42. When not extended, the second segment 40 may be disposed in an alternative position inside the first segment 38. The third segment 42 is telescopically extendable to be disposed farthest from the bridge assembly 34. The third segment 42 is formed substantially as a cylindrical tube having a smaller diameter than both the first and second segments 38 and 40. When not extended, the third segment 42 may be disposed in an alternative position inside the second segment 40.

Each of the legs 36 in the first leg assembly 30 extend from a first receptor 44. In the depicted embodiment, the first receptor 44 includes a rotatable socket 46 for receiving each of the legs 36 of the first leg assembly 30. The rotatable socket 46 is disposed to be oriented toward a surface upon which the legs 36 are fixed when the mounting apparatus 22 is assembled for operation or support of the illuminating head 24. In general, a range of motion of the rotatable socket 46 is sufficient to permit the legs 36 to be extended from a collapsed position in which the legs 36 are disposed substantially parallel to each other to the position shown in FIG. 2 in which a spacing between the legs 36 increases as a distance from the first receptor 44 increases. The rotatable socket 46 may be formed by inserting the first segment 38 into a channel formed in a portion of the first receptor 44. A rod may then be passed through an orifice on one side of the channel to penetrate through an end portion of the first segment 38 and an aligned orifice on the opposite side of the channel. Accordingly, the first segment 38 may rotate about the rod from the position in which the legs 36 are disposed substantially parallel to each other to the position shown in FIG. 2. Each of the legs 36 of the second leg assembly 32 extend from corresponding rotatable sockets of a second receptor 48 in a similar manner to that described above.

When the legs 36 are fully extended, fasteners 50 disposed at opposite ends of the second segment 40 may be used to fix each of the segments 38, 40 and 42 in an extended position. In an exemplary embodiment, the fasteners 50 may include an internally disposed thread assembly (not shown) which engages a thread assembly disposed, for example, to extend around an external circumference of the third segments at an end of the third segment 42 closest to the second segment when extended. The second segment 40 also includes a similar thread assembly. Thus, for example, the fasteners 50 may be rotated in a first direction to tighten a connection between the thread assembly of the fasteners 50 and the second and third segments 40 and 42, and be rotated in a second direction to loosen the connection.

It should be noted that although the present embodiment describes a telescoping extension mechanism for the legs 36, other means of extension and other means of fastening segments are also possible. For example, the legs 36 may include segments that are foldable via hinges or ball joints. Alternatively, the legs 36 may include segments that are removable that can be assembled using, for example, a screw fitting, a snap fitting, or any other mechanism for fastening. As another alternative fastening means, a telescoping segment may have detents that are extendable to fix a position of one segment with respect to another when the detents are aligned with a corresponding orifice. Additionally, other fittings are also possible to secure telescoped folded, removable or otherwise articulated leg segments and the fittings described herein should not be viewed as limiting in this regard.

The first and second receptors 44 and 48 also include a receiving hole (not shown) for receiving and supporting a support rod 52 upon which the illuminating head 24 is disposed. The support rod 52 is typically disposed in either of the first and second receptors 44 and 48 and oriented to extend in a direction substantially opposite to the direction of extension of the legs 36 when the mounting apparatus 22 is arranged for operation or support of the illuminating head 24.

The bridge assembly 34 includes a battery pack 56 and a fixing apparatus 58. In an exemplary embodiment, the fixing apparatus 58 is releasably coupled to both the first and second receptors 44 and 48 at opposite ends of the fixing apparatus 58, respectively. The fixing apparatus 58 includes a receiving space for receiving and supporting the battery pack 56. The fixing apparatus 58 may comprise a single unitary piece of metal, plastic, or other suitable materials. Alternatively, the fixing apparatus 58 may include a plurality of articulated components arranged to provide a support platform for the battery pack 56 and provide stability to the mounting apparatus 22 by virtue of the bridge between the first and second leg assemblies 30 and 32. In an exemplary embodiment, the fixing apparatus 58 may include a first rod 62 disposed between one end of the battery pack 56 and the first receptor 44 and a second rod 64 disposed between an opposite end of the battery pack 56 and the second receptor 48. The first and second rods 62 and 64 may include a fastener at each longitudinal end of the first and second rods 62 and 64 to permit coupling of the first and second rods 62 and 64 to respective ends of the battery pack 56 and the first and second receptors 44 and 48, respectively. For example, the fastener could be a snap fitting, a screw fitting, a nut and bolt assembly, etc. The fixing apparatus 58 may also include a strap 66 that extends around a circumference of the battery pack 56 in mechanical communication with each of the first and second rods 62 and 64. Additionally, a carriage rod 68 may extend from the first rod 62 to the second rod 64 and be formed substantially in a "U" shape in order to receive the battery pack 56. In alternate embodiments, other structures may be used to secure the battery pack 56 to the bridge assembly 34 as will be apparent to one of skill in the art in view of this disclosure.

The battery pack 56 may include any suitable battery element including rechargeable lead acid batteries, rechargeable lithium ion batteries, etc. However, in an exemplary embodiment, the battery pack 56 is a rechargeable lithium ion battery such as, for example, a standard UBI-2590 Li-ion battery. Accordingly, a battery charger (not shown) may be coupled to the battery pack 56 as desired to replenish a state of charge of the battery pack 56. The battery pack 56 may be enclosed in a protective case.

In the depicted embodiment, the battery pack 56 is in electrical communication with electronics components of the illuminating head 24 via a power cable 70. The electronics components may be disposed, for example, in an electronics enclosure 72 and include any devices or means embodied in hardware, software, or a combination of hardware and software that are capable of providing power and control functions, such as beam shaping functions, for light emitters of the illuminating head 24. The electronics components may be controlled and the battery pack 56 may be monitored via a user interface 74 disposed on a face of the electronics enclosure 72. It should also be noted that although the present embodiment is described as being powered by the battery pack 56, other power sources are also available (e.g., battery, wall outlet power supply, mobile cord power supply, etc.).

Referring now to FIG. 3, a schematic drawing is provided illustrating a functional block diagram of the illumination head 24 according to an exemplary embodiment of the present invention. According to the depicted embodiment, the illumination head 24 includes an electronic circuit board 100 for supporting and electronically connecting an LED driver module 104, a power module 106, a fuel gauge sensor module 110, a process control element 112, and a user interface module 114. In various embodiments, these systems combine to define a control circuit 120 that is the backbone of the illuminating head 24.

In the depicted embodiment, the control circuit 120 is adapted to provide input signals from the user interface module 114 to the process control element 112, which may be embodied, for example, as a CPU, chip, digital signal processor, microcontroller, or other similar device. The user interface module 114 may accept control inputs from a user via the user interface 74. The process control element 112 processes these inputs and transmits corresponding signals to the LED driver module 104. In this regard, LEDs forming lighting elements of the illuminating head 24 may be caused to illuminate in a manner (e.g., spot-light, flood-light, or combination thereof) and intensity that is selected by the user.

In some embodiments, the internal operations, power-use and monitoring, beam-shaping, and user control functions of the illuminating head 24 may be performed via the structures, circuitry, processes and operations disclosed in commonly-owned U.S. patent application Ser. No. 11/336,562, which was filed Jan. 21, 2006 and is entitled "Portable Light Device." The foregoing application claims priority of U.S. Provisional Application No. 60/645,788 filed Jan. 21, 2005 and both applications are hereby incorporated by reference in their entirety.

Returning to the schematic diagram illustrated by FIG. 3, the power module 106 provides power to the process control elements 112 and to other modules of the illuminating head 24. The power module 106 is disposed in communication with the battery pack 56 via the power cord (shown as item 70 in FIG. 2) to receive power for the illuminating head 24. In the depicted embodiment, a fuel gauge sensor module 110 is provided to sense electrical power information related to the state of charge of the battery pack 56 and to provide corresponding electrical signal and/or data inputs to the process control element 112. The electrical power information may be processed using, for example, an algorithm used to calculate state of charge of the battery pack 56, which may be communicated in terms of a percentage of charge remaining relative to a full charge state.

For purposes of the present invention and appended claims, the term "electrical power information" refers to battery current flow during charge or discharge operations, battery voltage, environmental factors such as battery temperature, ambient temperature, ambient humidity, and the like, and non-battery power information such as the presence or absence of external power sources (e.g., wall outlets, vehicle batteries, etc.) and the presence or absence of external power drains (e.g., device drawing power from the battery pack 56 such as PDAs, laptops, cell phones, vehicle batteries, etc.). The process control 112 may be adapted to interpret these signals and provide power supply messages to a display of the user interface 74.

Various process control elements are currently known that possess fuel gauge sensing functionality. For example, in one embodiment, a PS810 fuel gauge microcontroller manufactured by Microchip Technology, Inc., may be used. In another embodiment, a dedicated fuel gauge system may be provided that is part of a battery pack or electrical power system that is adapted to provide input signals and data to a separate process control element that is adapted for driving the illuminating head 24.

Operation of the illuminating head 24 is controlled by the user interface 74 as shown in greater detail by FIG. 4. In the depicted embodiment, the user interface 74 includes first and second adjustable members 76 and 78, a toggle switch 80, and a display 82. In one embodiment, the toggle switch 80 may be adapted to disconnect battery power in order to disconnect erosion of battery capacity during power off conditions. In another embodiment, the toggle switch 80 may be adapted to disconnect battery power and disconnect power from other power sources (e.g., power cords, etc.). In still other embodiments, the toggle switch 80 may be adapted to toggle between various modes of operation including, but not limited to, a brightness control mode, an illumination control mode, and the like. Additional switches, toggles, potentiometers, etc. may be provided as part of the user interface 74 to select the type or capacity of an installed battery, calibration of the illuminating head 24, a self-calibration or test mode, and other functionalities in addition to those expressly set forth herein.

In one embodiment of the present invention, the illuminating head 24 may be disposed in a brightness control mode wherein the first and second adjustable members 76 and 78 are electrically coupled to first and second potentiometers (not shown) that are provided in electrical communication through a process control element with the illuminating head 24 for controlling the illumination brightness or intensity of lighting elements of lighting modules of the illuminating head 24. For example, in one embodiment, the first adjustable member 76 may be adapted to control the brightness of one or more LEDs configured for spot-light illumination of white light and the second adjustable member 78 may be adapted to control the brightness of one or more LEDs configured for flood-light illumination of white light. Alternatively or additionally, for example, the first and second adjustable members 76 and 78 may be adapted to control the brightness of one or more LEDs configured for spot-light illumination of IR light and the second adjustable member 78 may be adapted to control the brightness of one or more LEDs configured for flood-light illumination of IR light. As yet another alternative, for example, the first adjustable member 76 may be used to select a mode, while the second adjustable member 78 is adapted to control the brightness of one or more LEDs selected for illumination in accordance with the selected mode. Accordingly, the first and second adjustable members 76 and 78 may incrementally adjust whether the illuminating head 24 will provide a spot-light mode of illumination, a flood-light mode of illumination, white light illumination, IR illumination or some combination thereof.

For example, in an exemplary embodiment, the first adjustable member 76 may be adapted to designate a percentage of available power that is supplied to one or more LEDs structured for spot-light illumination. Any remaining power may be supplied to one or more LEDs structured for flood-light type illumination. Thus, the first adjustable member 76 may define a spot-light position wherein approximately 100 percent of the available power from the electrical power system is directed to one or more LEDs structured for spot-light illumination, a flood-light position wherein approximately 100 percent of the available power is directed to one or more LEDs structured for flood-light type illumination, and multiple dual mode illumination positions wherein a percentage less than 100 percent of the available power is directed to the spot-light type LEDs and substantially all remaining available power is directed to the flood-light type LEDs. The first adjustable member 76 may have separate modes for white light, IR light or a combination of IR and white light. Alternatively, one or more additional toggle switches and/or adjustable members may be provided to enable further selectivity of the illumination features and process discussed above.

In illumination control mode embodiments such as the example provided above, the second adjustable member 78 may be adapted to control the brightness or intensity of the illumination provided regardless of whether the first adjustable member 76 is disposed in a spot-light position, a flood-light position, a duel mode position, or which type of light (e.g., white, IR, etc.) is emitted. In one embodiment, the second adjustable member 78 may be configured to restrict the available power that is distributed to the illuminating head 24. For example, the second adjustable member 78 may be set to provide 60 percent of the available power to the LED driver module 104. This 60 percent of available power would then be routed to either the spot or flood light type of LEDs based on the position of the first adjustable member 76 as described above. In such embodiments, the second adjustable member 78 may be set to provide generally between 0 and 100 percent of the available power to the LED driver module 104 as will be apparent to one of ordinary skill in the art.

As noted above, the user interface 24 may include a display 82 such as the depicted liquid crystal display. In the depicted embodiment, the display 82 is disposed in electronic communication with the fuel gauge sensor module 110 and is thereby adapted to display a power supply message including the percentage of battery charge capacity remaining and/or the battery charge capacity remaining in units of time (e.g., months, weeks, days, hours, minutes, seconds, etc.). The display 82 may also indicate which power source is presently activated (e.g., battery, wall outlet power supply, mobile cord power supply, etc.) and whether a power drain device (e.g., cell phone, laptop, radio, PDA, vehicle battery, etc.) is drawing power from the electrical power system. The display 82 may also indicate other system information including, but not limited to, the mode of operation, system configuration data, calibration data, system status information, and other information.

Additionally, the display 82 may provide an indication of the brightness or intensity of the illumination provided by the lighting apparatus in the brightness control mode and/or may provide an indication of the relative positions of the first and second adjustable members 76 and 78 in the illumination control mode. For example, the display 82 could indicate that 75 percent of lighting apparatus' available power is directed to its array of LEDs with 20 percent of that power being directed to spot-light type LEDs for white light while 80 percent of that is power is directed to flood-light type LEDs for white light. The display 82 may also provide an indication from the fuel gage sensor module 110 regarding an estimated time for which battery power is available in the current mode of operation. Finally, the display 82 may provide other information related to the operation of the illuminating head 24 as may be apparent to one of ordinary skill in the art in view of this disclosure.

In another embodiment of the present invention, one or more program modes may be stored in a non-volatile memory (e.g., flip-flop or other two-state device, flash memory, EEPROM, CMOS, etc.) of the lighting apparatus. Such program modes may define specific illumination control modes (e.g., spot, flood, ultraviolet, infrared, etc.), specific brightness or intensity levels, and programs for varying illumination output based upon various parameters including electrical power information, ambient light levels, intervals of time, motion sensing input, and the like. For example, in one embodiment, a lighting apparatus may include a program mode that provides selected brightness or intensity levels based upon selected levels of electrical power system capacity.

In another exemplary embodiment, the illuminating head 24 may include an antenna element 130. The antenna element 130 may be in electrical communication with the process control element 112 to receive wireless control signals from an external source or transmitter. The antenna element 130 may be tuned to any suitable frequency for communication with the external source or transmitter. The process control element 112 may communicate with the antenna element to provide all necessary means, systems, and/or devices to enable receipt and decoding, if necessary, of wireless control signals received at the antenna element 130.

Lighting elements of the illuminating head 24 will now be described in greater detail with reference to FIGS. 5-9. FIG. 5 is a front view of an illuminating head 24 structured according to one exemplary embodiment of the present invention. The depicted illuminating head 24 includes four lighting element modules 142, 144, 146, 148; however, more or fewer lighting element modules may be provided in alternate embodiments. Each lighting element module includes one or more light emitters (e.g., LEDs, IR light emitters, etc.) as will be discussed in greater detail below. The depicted lighting element modules are disposed in a vertically stacked arrangement; however, other lighting element module arrangements may be used (e.g., a vertically stacked arrangement, a horizontally stacked arrangement, a diagonal arrangement, and/or some combination thereof).

In various embodiments of the invention, each of the lighting element modules is disposed adjacent to a shadow plate 140. The depicted shadow plate 140 is rectangularly shaped and defines a substantially planar reflective surface 141 having a polished face that is disposed in a direction of intended illumination. The shadow plate 140 may be made from, for example, polished aluminum or other reflective metals to form a mirror-like surface. In other embodiments, the shadow plate 140 may be painted or coated with a flat white finish. In still other embodiments, the shadow plate 140 may be from an opaque composite or polymer that is configured to have a reflective or flat finish. In the depicted embodiment, the shadow plate 140 physically separate the electronics enclosure 72 from the lighting element modules and optically reflects light emitted from the light emitters toward a direction of intended illumination (e.g., the illumination zone 18 of FIG. 1) and away from a direction of intended darkness (e.g., the darkened zone 16 of FIG. 1).

In various embodiments, the size and shape of the shadow plate 140 may be selected based on the preferred illumination range. For example, the depicted substantially planar shadow plate 140 is designed to produce a preferred illumination range of approximately 180 degrees depending upon the position of the light emitters relative to the shadow plate. If a smaller illumination range were preferred, the shadow plate may lengthened, curved or bent to define a generally concave surface. Alternatively, if a larger illumination range were preferred, the shadow plate may be shortened, curved or bent to define a generally convex surface. Thus, as will be apparent to one of skill in the art in view of this disclosure, the size, shape, and thickness of the shadow plate may be tailored to particular illumination application. In one embodiment, the shadow plate 140 is thermally conductive (i.e., formed from a thermally conductive material such as aluminum, copper, metal filled polymer, metallic layered composite, etc.) and thermally connected to the lighting element modules, thereby operating as a heat sink or heat dissipater as will be described in further detail below.

As noted above, the depicted illuminating head 24 include a first lighting element module 142, a second lighting element module 144, a third lighting element module 146 and a fourth lighting element module 148. In the depicted embodiment, each lighting element module is sandwiched between focusing plates 150, 152, 172, 190, and 210 as shown. For example, the first lighting element module 142 is disposed between first focusing plate 150 and second focusing plate 152. The second lighting element module 144 is disposed between second focusing plate 152 and third focusing 172. The third lighting element module 146 is disposed between third focusing plate 172 and fourth focusing plate 190. The fourth lighting element module 148 is disposed between fourth focusing plate 190 and fifth focusing plate 210. Although not wishing to be bound by theory, the focusing plates 150, 152, 172, 190, and 210 are provided to reflect, direct, and/or otherwise focus light that is originally emitted by the light emitters in an undesirable generally vertical direction (i.e., upwardly, downwardly, and/or angularly away from an intended area of illumination) and toward an intended area of illumination.

In the depicted embodiment, each focusing plate defines a semi-circular shape. However, as will be apparent in view of this disclosure, the focusing plates may adopt other shapes so long as they reflect, direct, and/or focus light emitted by the light emitters in a direction of intended illumination. The focusing plates may be made from, for example, polished aluminum or other reflective metals. In other embodiments, the focusing plates may be made an opaque composite or polymer that is configured to have a reflective or flat finish. In one embodiment, as noted with respect to the shadow plate above, the focusing plates may be thermally conductive (i.e., formed from a thermally conductive material such as aluminum, copper, metal filled polymers, metal-layered composites, etc.) and thermally connected to the lighting element modules, thereby operating as a heat sink or heat dissipater for the light emitters (e.g., LEDs) associated with such modules.

The depicted first lighting element module 142 functions as an IR spot light. The first light element module 142 comprises first and second IR emitters that are disposed in first and second focusing devices 154, 156 that are adapted to act as a narrowing lens and focus light emitted from the first and second IR emitters into a spot-light mode of illumination. For purposes of the present invention and appended claims the term "focusing device" or "narrowing lens" includes any lens (e.g., fish-eye, elliptical, conical, etc.), reflector, optic, concentrator, or other device that is capable of reflecting or focusing light. Referring to FIG. 5A, focusing devices or lenses structured in accordance with various embodiments of the present invention, such as the exemplary depicted LED optic 101, are generally conically-shaped and possess a reflective lens surface 103 positioned in reflective proximity to a centrally located light emitter 102 (e.g., LED) as shown. In various embodiments, such focusing devices may be comprises of ceramic materials, glass materials, polymers, composites, or combinations thereof. In still other embodiments, such focusing devices may be structured to narrow light emitter from a centrally located light emitter 102 to an illumination cone angle θ of approximately 4 to 50 degrees, preferably between 15 to 50 degrees, more preferably between 4 and 30 degrees, and still more preferably between 4 and 15 degrees.

Returning to FIG. 5, the depicted first focusing device 154 is oriented in a first direction and the second focusing device 156 is oriented in a second direction. In the depicted embodiment, the orientation of the first and second directions are dictated by the mounting structure that supports the fist light element module as shown in greater detail in FIG. 6. In one embodiment, the first and second white light emitting LEDs 163, 165 (and the first and second focusing devices although not shown for convenience purposes) are supported by a first wedge support 160. As shown in the top section view provided by FIG. 6A, the depicted first wedge support 160 is configured to direct the focusing devices 154, 156 at an angle of 74 degrees off of center (as defined by centerline C). The depicted first wedge support 160 includes five sides 164, 168, 170, 166, and 167 and top and bottom surfaces 171, 172 as shown in FIG. 6. The thickness of the depicted first wedge support 160 is approximately on inch. As will be apparent to one of ordinary skill in view of this disclosure (and particularly in view of the exemplary mounting structures discussed with regard to the second, third, and fourth lighting element modules), by varying the size, shape, and thickness of the first wedge support 160 and/or by varying the mounting position of the light emitters (e.g., LEDs of various types, colors, etc.), the first lighting element module may be configured to direct light in a wide variety of directions.

In various embodiments, the first wedge support 160 may be thermally conductive (i.e., formed from a thermally conductive material such as aluminum, copper, metal filled polymers, metal-layered composites, etc.) and thermally connected to the lighting element modules (e.g., mounted using a thermal grease, thermal epoxy, solder filled polymer, solder, etc.), thereby operating as a heat sink or heat dissipater for such lighting element modules. In yet another embodiment, the first wedge support 160 may define a plurality of orifices 161, which may operate to reduce the weight of the wedge support, provide wiring pathways, and/or to provide holes for receiving mechanical fasteners, etc. Although depicted as oriented in a generally vertical direction, orifices 161 structured in accordance with various embodiments of the invention are not limited to this direction and may proceed through the wedge support as needed in conformity with their desired function. In one embodiment, a centrally disposed vertically aligned orifice may be provided that is sized to receive a support rod (shown in FIG. 2 and FIG. 5 as item 52), which is configured as the structural backbone supporting the illuminating head.

As noted above, the depicted first wedge support 160 includes five sides 164, 168, 170, 166, and 167 and top and bottom surfaces 171, 172. In the depicted embodiment, top and bottom surfaces 171, 172 are disposed in secure face-to-face contact with opposed focusing plates 150, 152. Depicted side 167 is disposed in secure face-to-face contact with shadow plate 140. Such contact may be assured through the use of removable fasteners or relatively fixed mounting methods such as welding, gluing, brazing, etc. A part from providing surfaces to mechanically support the shadow plate and focusing plates, this direct contact provides a thermal pathway through which heat produced by the light emitters may be dissipated. To assist in this regard, thermal greases, thermal epoxies, solder filled polymers, solders, or other similar thermal interface materials may be provided between contacting surface to fill any gaps inherently provided therebetween.

In one embodiment, the second lighting element module 144 functions as a flood light that is adapted to emit visible or white light. The depicted second lighting element module 144 includes a second wedge support 174 that defines four sides 180, 184, 182, and 181 and top and bottom surfaces 185, 186. The thickness of the depicted second wedge support is ½ inch. The depicted second wedge support 174 includes a first array of LEDs 176 disposed on side 180, a second array of LEDs 177 disposed on side 184, and a third array of LEDs 178 disposed on side 182. Depicted LED array 177 is aligned with a centerline C while LED arrays 176 and 178 are oriented at an angle offset by 60 degrees relative to centerline C as shown in the top section view provided by FIG. 7A. It should be noted that although the depicted arrays 176, 177, 178 include 4, 2 and 4 LEDs, respectively, any number of LEDs may be proved for each array depending on application requirements and/or user preferences. Further, as discussed above, other types of light emitters may be used with or without focusing devices on any one of the wedge support sides.

In the depicted embodiment, top and bottom surfaces 185, 186 of the second wedge support 174 are disposed in secure face-to-face contact with opposed focusing plates 152, 172. Depicted side 181 is disposed in secure face-to-face contact with shadow plate 140. Such contact may be assured through the use of removable fasteners or relatively fixed mounting methods such as welding, gluing, brazing, etc. Apart from providing surfaces to mechanically support the shadow plate and focusing plates, this direct contact provides a thermal pathway through which heat produced by the light emitters may be dissipated. To assist in this regard, thermal greases, thermal epoxies, solder filled polymers, solders, or other similar thermal interface materials may be provided between contacting surfaces to fill any gaps inherently provided therebetween.

The depicted second wedge support 174 may include orifices 161 similar to those described above with regard to the first wedge support 160. Such orifices 161 may function as described in detail above. For example, the second wedge support may include a centrally disposed vertically aligned orifice that is aligned with a similar orifice provide in the first wedge support and sized to receive a support rod (shown in FIG. 2 and FIG. 5 as item 52), which is configured as the structural backbone supporting the illuminating head. In various embodiments, the size, shape, and pattern of orifices defined among wedge supports may be identical substantially identical, or altogether different.

In one embodiment, the third lighting element module 146 functions as a flood light that is adapted to emit IR light. The depicted third lighting element module 146 includes a third wedge support 192 that defines six sides 198, 202, 206, 204, 200, and 203 and top and bottom surfaces 205, 207 as shown in FIG. 8. The thickness of the depicted third wedge support 192 is ¾ inch. The depicted third wedge support 192 includes a first IR emitter 194 disposed on side 202 and a second IR emitter 196 disposed on side 196. As shown in the top section view provided by FIG. 8A, the depicted first and second IR emitters 194, 196 are oriented at an angle offset by 45 degrees relative to centerline C. It should be noted that although the depicted light emitters are IR emitters, which each house an array of IR LEDS, many differing types of light emitters may be used in connection with the inventive concepts herein described. Further, as discussed above, other types of light emitters may be used with or without focusing devices on any one of the wedge support sides.

In the depicted embodiment, top and bottom surfaces 205, 207 of the third wedge support 192 are disposed in secure face-to-face contact with opposed focusing plates 172, 190. Depicted side 203 is disposed in secure face-to-face contact with shadow plate 140. Such contact may be assured through the use of removable fasteners or relatively fixed mounting methods such as welding, gluing, brazing, etc. Apart from providing surfaces to mechanically support the shadow plate and focusing plates, this direct contact provides a thermal pathway through which heat produced by the light emitters may be dissipated. To assist in this regard, thermal greases thermal epoxies, solder filled polymers, solders, or other similar thermal interface materials may be provided between contacting surfaces to fill any gaps inherently provided therebetween.

The depicted third wedge support 192 may include orifices 161 similar to those described above with regard to the first and second supports. Such orifices 161 may function as described in detail above. For example, the third wedge support may include a centrally disposed vertically aligned orifice that is aligned with similar orifices provide in the first and second wedge supports and which is sized to receive a support rod (shown in FIG. 2 and FIG. 5 as item 52), which is configured as the structural backbone supporting the illuminating head. In various embodiments, the size, shape, and pattern of orifices defined among wedge supports may be identical, substantially identical, or altogether different.

In one embodiment, the fourth lighting element module 148 functions as a spot light that is adapted to emit white or visible light. The depicted fourth lighting element module 148 includes a fourth wedge support 212 that defines eight sides 220, 224, 228, 232, 230, 226, 222, and 221 and top and bottom surfaces 225, 227 as shown in FIG. 9. The thickness of the depicted fourth wedge support 212 is on inch. The depicted fourth wedge support 212 includes a first LED 194 disposed on side 220, a second LED 214 disposed on side 228, a third LED 215 disposed on side 230, and a fourth LED 216 disposed on side 222. Although not shown for convenience purposed in FIG. 9, each of the depicted LEDs is disposed in a focusing device 155 as shown in FIG. 5.

Turning to the top section view provided by FIG. 9A, the depicted first, second, third, and fourth LEDs 213, 214, 215, 216 are oriented at various angles relative to centerline C. For example, the depicted first and fourth LEDs 213, 216 are oriented at 85 degrees off the centerline C and the depicted second and third LEDs 214, 215 are oriented at 75 degrees off the centerline. It is noted that although the fourth light element module is described in connection with white light transmitting LEDs, various other types of light emitters or arrays of light emitters may be used. Additionally, as discussed above, such other types of light emitters may be used with or without focusing devices and may be disposed any one of the wedge support sides.

In the depicted embodiment, top and bottom surfaces 225, 227 of the fourth wedge support 212 are disposed in secure face-to-face contact with opposed focusing plates 190, 210. Depicted side 221 is disposed in secure face-to-face contact with shadow plate 140. Such contact may be assured through the use of removable fasteners or relatively fixed mounting methods such as welding, gluing, brazing, etc. Apart from providing surfaces to mechanically support the shadow plate and focusing plates, this direct contact provides a thermal pathway through which heat produces by the light emitters may be dissipated. To assist in this regard, thermal greases, thermal epoxies, solder filled polymers, solders, or other similar thermal interface materials may be provided between contacting surfaces to fill any gaps inherently provided therebetween.

The depicted fourth wedge support 212 may include orifices 161 similar to those described above with regard to the first, second, and third wedge supports. Such orifices 161 may function as described in detail above. For example, the fourth wedge support may include a centrally disposed vertically aligned orifice that is aligned with similar orifices provided in the first, second, and third wedge supports and which is sized to receive a support rod (shown in FIG. 2 and FIG. 5 as item 52), which is configured as the structural backbone supporting the illuminating head. In various embodiments, the size, shape, and pattern of orifices defined among wedge supports may be identical, substantially identical, or altogether different.

FIG. 10 is illustrates a lighting apparatus 512 having an illuminating head 524 structured in accordance with another embodiment of the present invention. The illuminating head 524 of this exemplary embodiment may be supported by a mounting apparatus 522 or quad-pod that is similar to that described above. Notably, the illuminating head 524 structured in accordance with the depicted embodiment omits the shadow and separating plates used in prior illuminating head embodiments to direct or otherwise reflect emitted light. Thus, the depicted illuminating head 524 may be partially useful in applications where it is not necessary for its emitted light to be focused only within a narrow field. For example, the depicted illuminating head 524 may be useful when servicing an automobile or aircraft in a remote, darkened location where a broad field of high intensity white light is needed.

FIG. 11 is a detail view of the illuminating head 524 depicted in FIG. 10. The depicted illuminating head 524 includes 32 LEDs that are adapted to transmit white or visible light. A housing 530 is provided for enclosing the electronic circuitry and control elements associated with the LEDs. The 32 LEDs are disposed in six vertical arrays 535, 540, 545, 550, 560, and 565. Arrays 540, 545, 550, and 560 include four LEDs 542 with each LED 542 having a concentrator or focusing device 555 that is capable of focusing the illumination provided by the LED into a spot-light pattern of illumination. LEDs that are used in connection with a focusing device may be referred to herein as spot-light type LEDs or LEDs that are adapted for a spot-light mode of operation. In one embodiment, the spot-light illumination pattern produced by each spot-light type LED may provide an illumination path of 10 degrees±5 degrees. By varying the type of focusing device used in connection with individual or multiple LEDs, various additional illumination paths may be achieved as will be apparent to one of ordinary skill in the art.

Arrays 535 and 565 each include eight LEDs 537 that are not enclosed by a concentrator or focusing device and therefore broadcast a much wider illumination path. These widely illuminating LEDs 537 as referred to herein as flood-light type LEDs or LEDs that are adapted for a flood-light mode of operation. In the depicted embodiment, the two arrays 535, 565 of flood-light LEDs are disposed on opposite sides of the arrays 540, 545, 560 of spot-light LEDs as shown. This configuration is shown in greater detail by the top section view of the illuminating head provided by FIG. 11A.

The spot- and flood-light LEDs of the depicted embodiments are each supported by a fifth wedge support 531 as shown. In one embodiment, the fifth wedge support 531 may define six LED support surfaces 531' as shown in the wedge detail view provided by FIG. 11B. For example, the fifth wedge support 531 may define six LED support surfaces 531' that are offset relative to one another by a selected angle (here, by 6 degrees) for directing the illumination provided by the six arrays of LEDs (items 535, 540, 545, 550, 560, 565 as shown in FIGS. 11 and 11A). In alternative embodiments, other LED array combinations and wedge support designs may be used.

FIG. 11C is a schematic illustration of an illuminating head 624 structured in accordance with yet another embodiment of the present invention. The depicted illuminating head 624 includes a forced air cooling system provided to sufficiently cool the LEDs while simultaneously allowing for a compact, relatively low-weight, heat sink. One or more switches, buttons, etc., may be provided for controlling the operation of the spot- and flood-light LEDs as generally described above.

FIG. 11D depicts an illuminating head 724 having only spot-light type LEDs 742 (i.e., LEDs having focusing devices 755) as may be structured in accordance with another embodiment of the invention. Alternatively, only flood-light type LEDs may be used (not shown) or some other combination or arrangement of spot- and flood-light LEDs may be used. The depicted LEDs are arranged in vertical arrays on a fifth wedge support 531 of the type described with regard to FIGS. 11A-B. Some embodiments may include uniform numbers of LEDs across each vertically arranged array or alternatively could include non-uniform numbers of LEDs across each vertically arranged array. In still other embodiments, the LEDs need not be vertically arranged but could be horizontally arranged, diagonally arranged, or the like.

FIG. 12 is a rear view of the illuminating head in FIG. 11. FIG. 13 is a side perspective view of the illuminating head depicted in FIG. 12. FIGS. 12 and 13 illustrate various perspectives of an illuminated head housing 530 structured in accordance with one embodiment of the invention.

FIGS. 14-22 depict a lighting apparatus 1012 having an illuminating head 1024 that is adapted for spot light mode, flood light mode, visible light mode, and IR mode operation in accordance with yet another embodiment of the present invention. FIG. 14 is a perspective view of two lighting apparatuses 1012 each supported by a mounting apparatus 1022 or quad-pod of the type described with regard to FIG. 2 above.

FIG. 15 depicts a side view of a single lighting apparatus 1012 structured in accordance with one embodiment of the present invention. The depicted lighting apparatus 1012 includes a mounting device 1022 or quad-pod as described above; however, the depicted lighting apparatus 1012 includes first and second battery packs 1056, 1056' and corresponding first and second power cords 1070, 1070'. In this regard, the depicted lighting apparatus 1012 is adapted to progress increased battery power (e.g., longer run times, longer run times and increased battery levels, etc.)

FIGS. 16-19 provide various detail views of the illumination head 1024 depicted in FIG. 15. In the depicted embodiment, the battery packs 1056, 1056' are disposed in electrical communication with electronics components of the illuminating head 1024. As noted above, various embodiments of the invention are not limited to powering by one or even two battery packs and may be supplied with power by a variety of other power sources (e.g., battery, wall outlet power supply, mobile cord power supply, solar power, etc.).

The electronics components needed to drive the illuminating head 1024 may be disposed, for example, in an electronics enclosure 1072 and may include any devices or means embodied in hardware, software, or a combination of hardware and software that are capable of providing power and control functions, such as beam shaping functions, for light emitters of the illuminating head 1024. The electronics components may be controlled and the battery packs 1056, 1056' may be monitored via a user interface 1074 disposed on a face of the electronics enclosure 1072. In addition, in various embodiments, the electronics may be controlled remotely through electromagnetic signals received by the antenna element 1001 shown in FIG. 19.

In one embodiment, the electronics enclosure 1074 is mounted to a rear surface of the illuminating head housing 1030 as shown. Notably, the depicted illuminating head housing 1030 includes air inlet openings 1002 for providing air to the illuminating head convection cooling system that will be described in greater detail below. Operation of the illuminating head 1024 is controlled by the user interface 1074. In the depicted embodiment, the user interface 1074 includes first and second adjustable members 1076 and 1078, a toggle switch 1080, a mode select button 1077, and a display 1082. In one embodiment, the toggle switch 1080 may be adapted to disconnect battery power in order to disconnect erosion of battery capacity during power off conditions. In another embodiment, the toggle switch 1080 may be adapted to disconnect battery power and disconnect power from other power sources (e.g., power cords, etc.). In still other embodiments, the toggle switch 1080 may be adapted to toggle between various modes of operation including, but not limited to, a brightness control mode, an illumination control mode, and the like. Additional switches, toggles, potentiometers, etc., may be provided as part of the user interface 1074 to select the type or capacity of an installed battery, calibration of the illuminating head 1024, a self-calibration or test mode, and other functionalities in addition to those expressly set forth herein.

FIG. 20 is a front detail view of the illuminating head 1024 depicted in FIGS. 16-19. Notably, in the depicted embodiment, the illuminating head housing (item 1030 in FIGS. 16-19) has been removed to expose internal system components. Notably, in contrast to prior illuminating head embodiments that included a wedge support for receiving LEDs, the present embodiment includes a substantially planar LED support plate 1110 that is adapted to receive one or more LEDs. In the depicted embodiment, the illuminating head 1024 includes first and second arrays of spot-light type visible light emitting LEDs 1113, 1114 and two spot-light type IR light emitting LEDs 1116, 1115. Notably, as described above, the spot-light type IR light emitting LEDs 1116, 1115 are comprised of IR light emitters that are used in connection with focusing devices.

The depicted illuminating head 1024 further includes a centrally disposed flood-light support plate 1120 that comprises first, second, third, and fourth arrays of flood-light type visible light emitting LEDs 1122, 1124, 1126, 1128 as shown. Notably, the flood-light support plate 1120 is raised relative to the LED support plate 1110 so that light may be generally free to emit from the flood-light type LEDs without obstruction by the adjacent focusing devices of the spot-light type LEDs.

In one embodiment, the first, second, third, and fourth arrays of flood-light type visible light emitting LEDs 1122, 1124, 1126, 1128 may be mounted to the flood-light support plate 1120 by means of a thermal epoxy or other similar material as shown in the detail view of the flood-light support plate 1120 which is provided as FIG. 20A. The depicted illuminating head 1024 further includes two IR emitters 1127, 1129 disposed on the flood-light support plate 1120 proximate the visible light emitting LEDs as shown. Notably, each IR emitter includes an array of IR emitting LEDs as illustrated in FIG. 20A. In various embodiments of the invention, more or fewer spot-light type visible light emitting LEDs, spot-light type IR light emitting LEDs, flood-light type visible light emitting LEDs, and flood-light type IR emitters may be used depending upon the selected application.

FIG. 21 illustrates an illuminating head 1024 having a cooling system 1200 structured in accordance with one embodiment of the present invention. The depicted cooling system 1200 is thermally coupled to the LED support plate 1110 and includes first and second heat sinks 1210, 1215. In one embodiment, the heat sinks 1210, 1215 may be passive (i.e., no forced air) and may include one or more internal heat pipes that accommodate rapid cooling the plurality of LEDs supported by the illuminating head 1024. Other cooling systems may be used in connection with the present embodiment without deviating from the inventive concepts herein described.

FIG. 22 is a partially exploded view of the electronics components housed in an electronics enclosure 1074 structured in accordance with one embodiment of the present invention. The depicted electronics components are of the type described in connection with FIG. 3 above, as will be apparent to one of ordinary skill in the art in view of the disclosure.

For illustration purposes, the foregoing discussion describes the operation of the exemplary illuminating head 1024; which is depicted in FIGS. 15-22. As noted above, the user interface 1074 includes first and second adjustable members 1076 and 1078, a toggle switch 1080, a mode select button 1077, and a display 1082. The toggle switch 1080 operates as a power shut off to preserve battery power. The mode selected button 1077 allows a user to select between three states, namely, an IR illumination mode, a white or visible illumination mode, or off. In one embodiment, a user may select between these modes by simply pressing the button 1077 to switch between "off" and "IR illumination" modes while pressing and holding the button 1077 for more than three seconds to engage the white or visible light mode. In this regard, inadvertent use of visible light is prevented in circumstances where such use is undesirable (e.g., security applications). In alternate embodiments, a simple three state toggle switch or other similar devices could be used to select between the three modes.

In the depicted embodiment, the first adjustable member 1076 sets the relative brightness or intensity of the engaged LEDs. For example, in one embodiment, if the illuminating head 1024 were disposed in IR mode the user may manipulate the first adjustable member 1076 designate a power output to the LEDs of between 1 to 24 watts. If the illuminating head 1024 were disposed in white or visible light mode, the user could manipulate the first adjustable member 1078 to designate a power output to the LEDs of between 1 to 48 watts. Various other power output ranges may be available depending upon the rating of the LEDs and related circuitry.

The depicted second adjustable member 1078 provides what is referred to herein a beam-shaping functionality. More specifically, the second adjustable member 1078 allows a user to select how much of the available power that the user would like to direct to the spot-light type LEDs and the flood-light type LEDs. For example, a user could allocate 30 percent of the available power to the flood-light type LEDs and 70 percent of the available power to the spot-light type LEDs. The spot light LEDs are thus primary engaged to allow the user far field visibility in a darkened environment while the flood-light type LEDs are engaged, albeit to a somewhat lesser extent, to provide near field visibility of a user's immediate environment. Advantageously, a user may thus tailor the light output of the illuminating head 1024 to match his or her environment.

For purposes of the above specification and foregoing claims, the term light emitting diode or "LED" may include without limitation high brightness white LEDs, blue LEDs, red LEDs, orange LEDs, amber LEDs, yellow LEDs, green LEDs, bi- or tri-color LEDs, multi-colored LEDs, infrared LEDs, and ultraviolet LEDs. Such LEDs advantageously provide a relatively high level of illumination with relatively minimal power requirements as compared to traditional incandescent or resistor-based light bulbs.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. An apparatus comprising:

a multi-mode illuminating head configured to:

emit at least one of a first wavelength of light or a second wavelength of light, distribute light of the first wavelength in at least one pattern of a plurality of patterns, and distribute light of the second wavelength in at least one of the plurality of patterns, wherein the plurality of patterns includes different patterns;

a bridge assembly;

a first leg assembly disposed at a first end of the bridge assembly comprising a first leg and a second leg, and a second leg assembly disposed at a second end of the bridge assembly comprising a third leg and a fourth leg.

2. The apparatus of claim 1, wherein the first wavelength of light is in the infrared spectrum and the second wavelength of light is in the visible spectrum.

3. The apparatus of claim 2, wherein the plurality of patterns includes a spot pattern and a flood pattern.

4. The apparatus of claim 3, wherein the multi-mode illuminating head comprises a plurality of lighting element modules, the plurality of lighting element modules comprising:

an IR flood module for emitting light in the infrared spectrum in the flood pattern, an IR spot module for emitting light in the infrared spectrum in the spot pattern, a visible flood module for emitting light in the visible spectrum in the flood pattern, and a visible spot module for emitting light in the visible spectrum in the spot pattern.

5. The apparatus of claim 4, wherein the IR flood module comprises a first support wedge for supporting light emitters, the first support wedge having opposing first and second edges about a central axis, wherein each of the first and second edges is oriented at about 45 degrees from the central axis.

6. The apparatus of claim 5, wherein the IR spot module comprises a second support wedge for supporting light emitters, the second support wedge having opposing first and second edges about a central axis, wherein each of the first and second edges is oriented at about 74 degrees from the central axis.

7. The apparatus of claim 4, wherein the visible flood module comprises a third support wedge for supporting light emitters, the third support wedge having opposing first and second edges about a central axis, wherein each of the first and second edges is oriented at about 60 degrees from a central axis.

8. The apparatus of claim 7, wherein the visible spot module comprises a fourth support wedge for supporting light emitters, the fourth support wedge having opposing first and second edges about a central axis and opposing third and fourth edges about a central axis, wherein each of the first and second edges is oriented at about 75 degrees from the central axis, and wherein each of the third and fourth edges is oriented at about 85 degrees from the central axis.

9. The apparatus of claim 1, wherein the multi-mode illuminating head includes an antenna in electrical communication with a control circuit, the antenna for receiving wireless communications, and wherein the control circuit is configured to control the plurality of lighting elements based on the received wireless communications.

* * * * *

UNITED STATES PATENT AND TRADEMARK OFFICE

CERTIFICATE OF CORRECTION

PATENT NO. : 7,922,353 B2
APPLICATION NO. : 11/688849
DATED : April 12, 2011
INVENTOR(S) : Isely It is certified that error appears in the above-identified patent and that said Letters Patent is hereby corrected as shown below:

In the Specifications:

Column 1,
Line 37, “frequency” should read --frequent--;
Line 64, “lift” should read --life--.

Column 2,
Line 25, “embodiments” should read --embodiment--.

Column 3,
Line 31, “rear” should read --top rear--.

Column 4,
Line 5, “embodiments” should read --embodiment--.

Column 5,
Line 2, “include” should read --includes--;
Line 50, “segments” should read --segment--.

Column 7,
Line 32, “priority of” should read --priority to--;
Line 38, “elements” should read --element--.

Column 9,
Line 7, “process” should read --processes--;
Line 14, “duel” should read --dual--.

Column 10,
Line 46, “separate” should read --separates--.

Signed and Sealed this
Twenty-eighth Day of August, 2012

David J. Kappos

David J. Kappos
*Director of the United States Patent and Trademark Office*

Column 11,
Line 43, “light” should read --lighting--.

Column 12,
Line 15, “on inch” should read --one inch--;
Line 60, “surface” should read --surfaces--.

Column 13,
Line 10, “proved” should read --provided--.

Column 14,
Line 30, “purposed” should read --purposes--;
Line 54, “produces” should read --produced--.

Column 15,
Line 15, “partially” should read --particularly--;
Line 44, “as referred” should read --are referred--.

Column 16,
Line 38, “progress” should read --possess--.